US006280917B1

(12) United States Patent
Ueda et al.

(10) Patent No.: US 6,280,917 B1
(45) Date of Patent: Aug. 28, 2001

(54) LATEX AND SILVER HALIDE PHOTOGRAPHIC LIGHT-SENSITIVE MATERIAL CONTAINING THE SAME

(75) Inventors: Eiichi Ueda; Nobuo Kubo; Chiaki Nagaike; Yasuo Kurachi, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/315,745

(22) Filed: May 20, 1999

(30) Foreign Application Priority Data

May 25, 1998 (JP) ..... 10-159886

(51) Int. Cl.[7] ..... G03C 1/053; G03C 1/93

(52) U.S. Cl. ..... 430/536; 430/537; 430/609; 430/627; 430/628; 428/521; 428/522

(58) Field of Search ..... 430/627, 628, 430/609, 536, 537; 428/522, 521

(56) References Cited

U.S. PATENT DOCUMENTS

| | | | | |
|---|---|---|---|---|
| 3,488,708 | * | 1/1970 | Smith et al. | 430/628 |
| 3,904,418 | * | 9/1975 | Mowrey et al. | 430/627 |
| 3,929,482 | * | 12/1975 | Ponticello et al. | 430/627 |
| 4,421,889 | * | 12/1983 | Braun et al. | 524/381 |
| 4,935,338 | * | 6/1990 | Masuda et al. | 430/628 |
| 6,087,081 | * | 7/2000 | Yamanouchi et al. | 430/536 |

* cited by examiner

*Primary Examiner*—Richard L. Schilling
(74) *Attorney, Agent, or Firm*—Frishauf, Holtz, Goodman, Langer & Chick, P.C.

(57) ABSTRACT

A latex comprising a polymer having an ethylenically unsaturated monomer unit containing an active methylene group and an ethylenically unsaturated monomer unit selected from methacrylic acid ester, acrylic acid ester, maleic acid ester and diene derivative, wherein said polymer is produced in the presence of a water soluble polymer through emulsion polymerization.

14 Claims, No Drawings

LATEX AND SILVER HALIDE PHOTOGRAPHIC LIGHT-SENSITIVE MATERIAL CONTAINING THE SAME

FIELD OF THE INVENTION

The present invention relates to an image forming material with improved layer intensity and to a novel latex containing an acetoacetoxy group and a silver halide photographic light-sensitive material containing the same, specifically to the novel latex containing the acetoacetoxy group which can improve storage stability, fogging by pressure and covering power of the silver halide photographic light-sensitive material and the silver halide photographic light-sensitive material employing the same.

BACKGROUND OF THE INVENTION

In an image forming material comprising a necessary layer on a support (for example, a silver halide light-sensitive material, a sheet used in a ink jet, a diffusion transfer image forming material and its receiving sheet, etc.), in recent years, enhancing an endurance has been demanded. Improvement of a layer peeling caused by with passage of time or by addition of strong power has been demanded. A hydrophilic colloidal layer constituting the silver halide photographic light-sensitive material is mainly composed of gelatin. However, when surface of the light-sensitive material is rubbed against foreign matter by virtue of weak force by which the hydrophilic colloidal layer is not destroyed, pressure is given to a silver halide through the gelatin which is binder to result in fog.

Various improvements of fogging by pressure have been proposed. For example, a method for increasing an amount of binder in a silver halide emulsion layer, a method for adding polymer latex to the emulsion layer described in Japanese Patent Publication Open to Public Inspection (hereinafter referred to as JP-A) No. 50-56227, a method for adding high boiling organic solvent to the emulsion layer described in JP-A Nos. 53-13923, 53-85421, a method for adding colloidal silica to the emulsion layer, a method for adding composite latex to the emulsion layer described in JP-A No. 1-177033, and a method for adding polymer latex containing an active methylene group to the emulsion layer described in JP-A Nos. 7-295130, 7-239523, are known. However, since still more toughness has been required in the silver halide photographic light-sensitive material, by these technique mentioned above, sufficient effect can not be obtained, furthermore storage stability and covering power tend to decrease.

A method for increasing intensity of wet gelatin membrane by adding the polymer latex containing the active methylene group to the light-sensitive material has been proposed in Japanese Patent Examined Publication Nos. 45-5819, 46-22507, JP-A Nos. 50-73625, 8-248548, 8-201950. Further, as active methylene latex polymerized in the presence of water soluble polymer, copolymerized latex derived from vinylacetate and monomer containing the active methylene group is described in JP-A 52-22030. However, there is no applied example in which the copolymerized latex derived from vinylacetate and monomer containing the active methylene group is employed in the light-sensitive material.

The inventors of the present invention examined improvement of the silver halide fog occurred by pressure generated by rubbing without decrease of storage stability and covering power, employing latex containing active methylene groups and found that active methylene latex polymerized in the presence of water soluble polymer could improve not only fogging by pressure but also storage stability and covering power.

SUMMARY OF THE INVENTION

An object of the present invention is to decrease fogging by pressure together with enhancement of storage stability and covering power, and provide active methylene latex to realize the above-mentioned object. And other object is to obtain an image forming material with improved layer intensity.

DETAILED DESCRIPTION OF THE INVENTION

Above objects of the invention could be attained by the following method.

(1) A latex comprising a polymer having an ethylenically unsaturated monomer unit containing an active methylene group and an ethylenically unsaturated monomer unit selected from methacrylic acid ester, acrylic acid ester, maleic acid ester and diene derivative, wherein said polymer is produced in the presence of a water soluble polymer through emulsion polymerization.

(2) The latex of item 1, wherein the water soluble polymer is an anionic water soluble polymer, a nonionic water soluble polymer or a natural polymer.

(3) The latex of item 1, wherein the water soluble polymer is an anionic water soluble polymer and said polymer is composed of not less than two kinds of monomer units selected from the ethylenically unsaturated monomer unit and a conjugated diene monomer unit, and content of an anionic monomer unit is not less than 60% in weight ratio.

(4) The latex of item 1, wherein the water soluble polymer is an anionic water soluble polymer and said polymer contains a conjugated diene type sulfonic acid or its alkaline salt.

(5) The latex of item 4, wherein the conjugated diene type sulfonic acid or its alkaline salt is styrenesulfonic acid or its alkaline salt.

(6) The latex of item 1, wherein the water soluble polymer is a nonionic water soluble polymer and said polymer is composed of not less than two kinds of monomer units selected from the ethylenically unsaturated monomer unit and a conjugated diene monomer unit, and content of a nonionic monomer unit is not less than 60% in weight ratio.

(7) The latex of item 1, wherein the water soluble polymer is a natural water soluble polymer which is dextran derivative.

(8) The latex of item 2, wherein the water soluble polymer contains acrylamide derivative or methacrylamide derivative unit.

(9) The latex of item 2, wherein the water soluble polymer contains vinylpyrrolidone unit.

(10) The latex of item 2, wherein glass transition temperature of said polymer is not lower than −20° C.

(11) The latex of item 1, wherein the polymer having the ethylenically unsaturated monomer unit containing the active methylene group and the ethylenically unsaturated monomer unit selected from methacrylic acid ester, acrylic acid ester, maleic acid ester and diene derivative produced in the presence of the water soluble polymer through emulsion polymerization is represented by the following Formula [1], $$-(A)x-(B)y-(C)z- \qquad \text{Formula [1]}$$

wherein, A represents the ethylenically unsaturated monomer unit containing the active methylene group represented by the following Formula [2], B represents the ethylenically unsaturated monomer unit selected from methacrylic acid ester, acrylic acid ester or maleic acid having glass transition temperature of not higher than 35° C., C represents the ethylenically unsaturated monomer other than A and B; x, y and z represent weight percentage ratio of each component in said polymer, and x, y and z each indicate $0.5 \leqq x \leqq 41$, $0 > y \leqq 59$, and $x+y+z=100$, $$CH_2{=}C(R^1)L{-}X \qquad \text{Formula [2]}$$

wherein $R^1$ represents a hydrogen atom, an alkyl group having 1 to 4 carbon atom(s) or a halogen atom, L represents a single bond or a divalent linking group, X represents a monovalent group containing an active methylene group.

(12) The latex of item 11, wherein x and y each indicate $2 \leqq x \leqq 20$ and $5 \leqq y \leqq 50$.

(13) The latex of item 12, wherein X of Formula [2] is $R^8COCH_2COO$—, $CNCH_2COO$—, $R^8COCH_2CO$— or $R^8COCH_2CON(R^5)$—, wherein $R^5$ represents a hydrogen atom, a substituted or an unsubstituted alkyl group having 1 to 6 carbon atom(s), and $R^8$ represents an alkyl group having 1 to 12 carbon atom(s), an aryl group, an alkoxy group, a cycloalkyloxy group, an aryloxy group, an amino group, the groups represented as $R^8$ may have a substituent.

(14) The latex of item 11, wherein B of Formula [1] is alkylacrylate having a branched alkyl chain having not more than two carbon atoms, alkylmethacrylate having a branched alkyl chain having not less than six carbon atoms or diene derivative of which glass transition temperature is not higher than 10° C.

(15) The latex of item 1, wherein the polymer having the ethylenically unsaturated monomer unit containing the active methylene group and the ethylenically unsaturated monomer unit selected from methacrylic acid ester, acrylic acid ester, maleic acid ester and diene derivative produced in the presence of the water soluble polymer through emulsion polymerization contains monomer unit having an anionic functional group in an amount of 0.5 to 20 wt % to total amount of the polymer.

(16) The latex of item 1, wherein an average particle size of said polymer is 0.01 to 1 $\mu$m.

(17) A latex comprising a polymer containing composition unit of a conjugated diene type sulfonic acid or its alkaline salt produced in the presence of an anionic water soluble polymer through emulsion polymerization represented by Formula [1], $$-(A)x-(B)y-(C)z- \qquad \text{Formula [1]}$$

wherein A represents an ethylenically unsaturated monomer unit having an active methylene group represented by Formula [2], B represents an ethylenically unsaturated monomer unit selected from methacrylic acid ester, acrylic acid ester or maleic acid ester of which glass transition temperature is not higher than 35° C., C represents an ethylenically unsaturated monomer unit other than A and B; x, y and z represent weight percentage ratio of each component in said polymer, and x, y and z each indicate $2 \leqq x \leqq 20$, $5 \leqq y \leqq 50$, and $x+y+z=100$, $$CH_2{=}C(R^1)L{-}X \qquad \text{Formula [2]}$$

wherein $R^1$ represents a hydrogen atom, an alkyl group having 1 to 4 carbon atom(s) or a halogen atom, L represents a single bond or a divalent linking group, and X is $R^8COCH_2COO$—, $CNCH_2COO$—, $R^8COCH_2CO$— or $R^8COCH_2CON(R^5)$—, wherein $R^5$ represents a hydrogen atom, a substituted or an unsubstituted alkyl group having 1 to 6 carbon atom(s), and $R^8$ represents an alkyl group having 1 to 12 carbon atom(s), an aryl group, an alkoxy group, a cycloalkyloxy group, an aryloxy group, an amino group, the groups represented as $R^8$ may have a substituent.

(18) An image forming material comprising a support and a layer, wherein said layer is formed by coating a solution containing the latex of item 1.

(19) The image forming material of item 18, wherein said image forming material is a silver halide light-sensitive material.

(20) The image forming material of item 19, wherein weight of solid component of latex is 0.1 to 1.5 times as much as that of gelatin in a layer containing the latex.

Next, the invention will be explained in detail

As to the structure of the polymer having the active methylene, one represented by the above-mentioned Formula [1] is specifically preferable. A of Formula [1] is a repetition unit derived from the ethylenically unsaturated monomer having the active methylene represented by the following Formula [2].

$$CH_2{=}C(R^1)L{-}X \qquad \text{Formula [2]}$$

wherein $R^1$ represents a hydrogen atom, an alkyl group having 1 to 4 carbon atom(s) or a halogen atom, L represents a single bond or a divalent linking group, which is concretely represented by the following Formula.

$$-(L^1)_m-(L^2)_n-$$

$L^1$ represents —CON($R^2$)— ($R^2$ represents a hydrogen atom, an unsubstituted alkyl group having 1 to 4 carbon atom(s) or a substituted alkyl group having 1 to 4 carbon atom(s) including not more than 6 carbon atoms in total), —COO, —NHCO—, —OCO—,

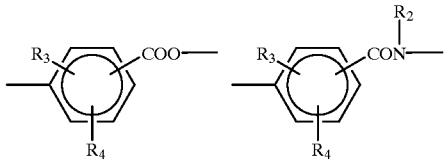

($R^3$ and $R^4$ each represent independently a hydrogen atom, a hydroxyl group, a halogen atom, a substituted or an unsubstituted alkyl group, a substituted or an unsubstituted alkoxy group, a substituted or an unsubstituted acyloxy group or a substituted or an unsubstituted aryloxy group), $L^2$ represents a linking group linking $L^1$ and X, m represents 0 or 1, n represents 0 or 1. The linking group represented by $L^2$ is exemplarily represented by the following Formula.

$$-[X^1-(J^1-X^2)_p-(J^2-X^3)_q-(J^3)_r]_s-$$

wherein $J^1$, $J^2$ and $J^3$ are the same or different and include —CO—, —$SO_2$—, —CON($R^5$)— ($R^5$ represents a hydrogen atom, an alkyl group having 1 to 6 carbon atom(s), a substituted alkyl group having 1 to 6 carbon atom(s)), —$SO_2N(R^5)$— ($R^5$ is previously defined), —N($R^5$)—$R^6$— ($R^5$ is previously defined, $R^6$ represents an alkylene group having 1 to 4 carbon atom(s)), —N($R^5$)—$R^6$—N($R^7$) ($R^5$ and $R^6$ are previously defined, $R^7$ represents a hydrogen atom, an alkyl group having 1 to 6 carbon atom(s), a substituted alkyl group having 1 to 6 carbon atom(s)), —O—, —S—, —N($R^5$)—CO—N($R^7$)— ($R^5$ and $R^7$ are previously defined), —N($R^5$)—$SO_2N(R^7)$— ($R^5$ and $R^7$ are previously defined), —COO—, —OCO—, N($R^5$)$CO_2$— ($R^5$ is previously defined), and —N($R^5$)CO— ($R^5$ is previously defined).

p, q, r, s represent 0 or 1. $X^1$, $X^2$ and $X^3$ are the same or different and each include alkylene group having 1 to 10 carbon atom(s), aralkylene group or phenylene group, each group may have a substituent. The alkylene group may be a straight chain or a branched chain. The alkylene group includes exemplarily methylene, methylmethylene, dimethylmethylene, dimethylene, trimethylene, tetramethylene, pentamethylene, hexamethylene, decylmethylene; the aralkylene group includes exemplarily benzylidene; the phenylene group includes exemplarily p-phenylene, m-phenylene, methylphenylene, etc.

X represents a monovalent group containing an active methylene group and as preferable examples are cited $R^8$—CO—$CH_2$—COO—, CN—$CH_2$—COO—, $R^8$—CO—$CH_2$—CO—, $R^8$—CO—$CH_2$—CON($R^5$)—, etc. Hereon, $R^5$ is previously defined, $R^8$ represents a substituted or an unsubstituted alkyl group having 1 to 12 carbon atom(s) (for example, methyl, ethyl, n-propyl, n-butyl, t-butyl, n-nonyl, 2-methoxyethyl, 4-phenoxybutyl, benzyl, 2-methanesulfonamideethyl,etc.), a substituted or an unsubstituted aryl group (for example, phenyl, p-methylphenyl, p-methoxyphenyl, o-chlorophenyl, etc.), a substituted or an unsubstituted alkoxy group (for example, methoxy, ethoxy, methoxyethoxy, n-butoxy, etc.), a substituted or an unsubstituted cycloalkyloxy group (for example, cyclohexyloxy), an aryloxy group (for example, phenoxy, p-methylphenoxy, o-chlorophenoxy, p-cyanophenoxy, etc.), an amino group, a substituted amino group (for example, methylamino, ethylamino, dimethylamino, butylamino, etc.).

Exemplified ethylenically unsaturated monomers having the active methylene group represented by A in the polymer represented by Formula [1] are shown below, but are not limited thereto.

MN-1 2-acetoacetoxyethylmethacrylate

MN-2 2-acetoacetoxyethylacrylate

MN-3 2-acetoacetoxypropylmethacrylate

MN-4 2-acetoacetoxypropylacrylate

MN-5 2-acetoacetoamidoethylmethacrylate

MN-6 2-acetoacetoamidoethylacrylate

MN-7 2-cyanoacetoxyethylmethacrylate

MN-8 2-cyanoacetoxyethylacrylate

MN-9 N-(2-cyanoacetoxyethyl)acrylamide

MN-10 2-propionylacetoxyethylacrylate

MN-11 N-(2-propionylacetoxyethyl)methacrylamide

MN-12 N-4-(acetoacetoxybenzyl)phenylacrylamide

MN-13 ethylacryloylacetate

MN-14 acryloylmethylacetate

MN-15 N-methacryloyloxymethylacetoacetoamide

MN-16 ethylmethacryloylacetoacetate

MN-17 N-arylcyanoacetoamide

MN-18 methylacryloylacetoacetate

MN-19 N-(2-methacryloyloxyethyl)cyanoacetoamide

MN-20 p-(2-acetoacetyl)ethylstyrene

MN-21 4-acetoacetyl-1-methacryloylpiperazine

MN-22 ethyl-α-acetoacetoxymethacrylate

MN-23 N-butyl-N-acryloyloxyethylacetoacetoamide

MN-24 p-(2-acetoacetoxy)ethylstyrene

An ethylenically unsaturated monomer giving repetition unit represented by B of Formula [1] is the monomer from which is obtained single polymer through polymerization of which glass transition temperature is not higher than 35° C. Exemplarily, the monomer includes alkylacrylate (for example, methylacrylate, ethylacrylate, n-butylacrylate, n-hexylacrylate, benzylacrylate, 2-ethylhexylacrylate, iso-nonylacrylate, n-dodecylacrylate, etc.), alkylmethacrylate (for example, n-butylmethacrylate, n-hexylmethacrylate, 2-ethylhexylmethacrylate, iso-nonylmethacrylate, n-dodecylmethacrylate, etc.), and diene derivative (for example, butadiene, isoprene, etc.).

More preferable monomer is one from which is obtained single polymer through polymerization of which glass transition temperature is not higher than 10° C. Exemplarily, the monomer includes alkylacrylate containing branched alkyl chain having not less than 2 carbon atoms (for example, ethylacrylate, n-butylacrylate, 2-ethylhexylacrylate, iso-nonylacrylate, etc.), alkylmethacrylate containing branched alkyl chain having not less than 6 carbon atoms (for example, n-hexylmethacrylate, 2-ethylhexylmethacrylate, etc.), and diene derivative (for example, butadiene, isoprene, etc.).

Values of glass transition temperature of the above-mentioned polymers are described in [Polymer Handbook], the third edition, edited by J. Brandrup and E. H. Immergut (John Wily & Sons. 1989) on pages VI/209 to VI/277.

The repitition unit represented by C of Formula (1) represents the repitition unit other than B, that is, the repitition unit derived from the monomer from which is obtained single polymer through polymerization of which glass transition temperature is more than 35° C.

Exemplarily, the monomer represents acrylic acid ester derivative (for example, t-butylacrylate, phenylacrylate, 2-naphthylacrylate, etc.), methacrylic acid ester derivative (for example, methylmethacrylate, ethylmethacrylate, 2-hydroxyethylmethacrylate, benzylmethacrylate, 2-hydroxypropylmethacrylate, phenylmethacrylate, cyclohexylmethacrylate, cresylmethacrylate, 4-chlorobenzylmethacrylate, ethyleneglycoldimethacrylate, etc.), vinyl ester derivative (for example, vinylbenzoate, pivaloyloxyethylene, etc.), acrylamide derivative (for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, diacetoneacrylamide, etc.), methacrylamide derivative (for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, etc.), styrene derivative (for example, styrene, methylstyrene, dimethylstyrene, trimethylstyrene, ethylstyrene, isopropylstyrene, methoxystyrene, acetoxystyrene, chlorostyrene, dichlorostyrene, bromostyrene, vinylbenzoic acid methyl ester, etc.), divinylbenzene, acrylonitrile, methacrylonitrile, N-vinylpyrrolidone, N-vinyloxazolidone, vinylidene chloride, phenylvinylketone, etc.

In the polymer represented by Formula [1] of the present invention, monomers having anionic functional groups (such as carboxyl group and sulfone group) described in JP-A Nos. 60-15935, 45-3822, 53-28086, U.S. Pat. No. 3,700,456 may be copolymerized in order to enhance the stabilization of latex.

These monomers include acrylic acid; methacrylic acid; itaconic acid; maleic acid; itaconic acid monoalkyl ester such as itaconic acid monomethyl ester, itaconic acid monoethyl ester; maleic acid monoalkyl ester such as maleic acid monomethyl ester, maleic acid monoethyl ester; citraconic acid; styrenesulfonic acid; vinylbenzylsulfonic acid; vinylsulfonic acid; acryloyloxyalkylsulfonic acid such as acryloyloxymethylsulfonic acid, acryloyloxyethylsulfonic acid, acryloyloxypropylsulfonic acid; methacryloyloxyalkylsulfonic acid such as methacryloyloxymethylsulfonic acid, methacryloyloxyethylsulfonic acid, methacryloyloxypropylsulfonic acid; acrylamidoalkylsulfonic acid such as 2-acrylamide-2-methylethanesulfonic acid, 2-acrylamide-2-methylpropanesulfonic acid, 2-acrylamide-2-methylbutanesulfonic acid; methacrylamidoalkylsulfonic acid such as 2-methacrylamide-2-methylethanesulfonic acid, 2-methacrylamide-2-methylpropanesulfonic acid, 2-methacrylamide-2-methylbutanesulfonic acid; these acids may be used in the form of salts with alkaline metals (for example, Na, K, etc.) or ammonium ion.

The monomer having the anionic functional group mentioned above can be used according to necessity to obtain latex stability in spite of high and low glass transition temperature of single polymer obtained from the monomer through polymerization. In cases where these monomers are used, preferable weight of these monomers is 0.5 to 20 wt % to total weight of polymer, more preferable weight is 1 to 10 wt %.

x, y and z of Formula [1] represent weight percentage of each component in said polymer latex. x, y and z each indicate $0.5 \leqq x \leqq 41$, $0 < y \leqq 59$, and $x+y+z=100$, preferably $2 \leqq x \leqq 20$ and $5 \leqq y \leqq 50$.

The composition of the polymer latex having the active methylene group according to the invention preferably satisfies the composition of the above-mentioned Formula [1], in order to obtain the superior result as to attain the object of the present invention. The glass transition temperature of the polymer latex of the invention is preferably not lower than −40° C., more preferably not lower than −20° C.

The polymer latex of the invention is prepared through emulsion polymerization. Although dipersing particle size is specifically not limited, preferable size range is 0.01 to 1.0 μm. In the emulsion polymerization method of the invention, as at least one kind of emulsifying agent, it is characterized that water soluble polymer is employed. The emulsion polymerization is carried out in the presence of the above-mentioned water soluble polymer in water or mixed solvent of water and water miscible organic solvent (for example, methanol, ethanol, acetine, etc.) by emulsifying monomers employing a radical polymerization initiator at 30° C. to about 100° C., preferably at 40° C. to about 90° C. An amount of the water miscible organic solvent is 0 to 100% to water in volume ratio, preferably 0 to 50%.

Polymerization reaction is usually carried out using 0.05 to 5 wt % of the radical polymerization initiator to the monomers which should be polymerized, and using 0.1 to 10 wt % of a emulsifying agent according to necessity. As polymerization initiators, are cited azobis compound, peroxide, redox solvent, exemplarily, potassium persulfate, ammonium persulfate, tert-butylperoctate, benzoylperoxide, iso-propylcarbonate, 2,4-dichlorobenzylperoxide, methyethylketoneperoxide, cumenehydroperoxide, dicumylperoxide, 2,2'-azobisiso-butylate, 2,2'-azobis(2-amidinopropane)hydrochloride, combination of potassium sulfite with sodium hydrogensulfite, etc.

As an emulsifying agent, anionic, cationic, amphoteric, nonionic surfactant can be used in combination with the water soluble polymer of the present invention. Using weight of the surfactant is 0 to 25 wt % to the using weight of the water soluble polymer, preferably 0 to 10 wt %. The surfactant includes sodium laurate, sodium dodecylsulfate, sodium 1-octoxycarbonylmethyl-1-octoxycarbonylmethanesulfonate, sodium dodecylnaphthalenesulfonate, sodium dodecylbenzenesulfonate, sodium dodecylphosphate, cetyltrimethylammonium chloride, dodecyltrimethyleneammonium chloride, N-2-ethylhexylpyridinium chloride, polyoxyethylenenonylphenylether, polyoxyethylenesorbitanlaurate ester, etc.

As to a water soluble polymer used in emulsion polymerization of the polymer latex of the present invention, most of water soluble natural polymers and water soluble synthesized polymers having a water soluble anionic group, a water soluble cationic group and a water soluble nonionic group in their chemical structures can be used. The anionic group includes carboxylic acid and its salt, sulfonic acid and its salt, phosphoric acid and its salt; the cationic group includes tertiary amine or ammonium salt; the nonionic group includes hydroxyl group, amide group, methoxy group, alkyleneoxide group such as oxyethylene, hetero atom ring such as pyrrolidone group. Of the water soluble synthesized polymers, the anionic or the nonionic polymer is preferable and the anionic polymer is specifically preferable. Further, the polymer having a sulfonic acid salt is more preferable and the polymer having polystyrenesulfonic acid salt and conjugated diene type sulfonic acid salt is still more preferable. The water soluble polymers my be used in combination of 2 kinds or more. The water soluble of the water soluble polymer means that not less than 1 g of the water soluble polymer is soluble in 100 g of water under a normal pressure at 25° C. when solubility reaches an equilibrium state.

As to the water soluble polymer used as an emulsifying agent in emulsion polymerization of the polymer latex of the present invention, water soluble polymers such as natural or semi-synthesized polymers are included, exemplarily, are cited algilic acid or its salt, dextran, dextransulfuric acid salt, glycogen, gum arabi, albumin, agar, starch derivative, carboxymathylcellulose or its salt, hydroxycellulose, cellulosesulfuric acid ester, and these derivatives.

The water soluble polymers used in emulsion polymerization of the polymer latex of the present invention are shown below, but are not limited thereto. The number attached to monomer unit indicates weight ratio in polymer.

SP-1

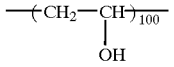

SP-2

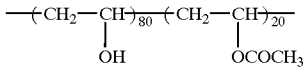

SP-3

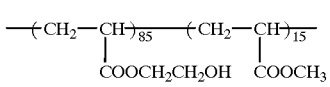

SP-4

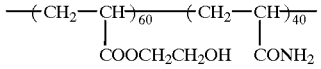

SP-5

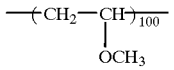

-continued
SP-6
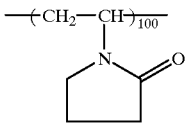
SP-7
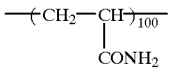
SP-8
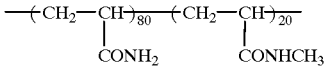
SP-9
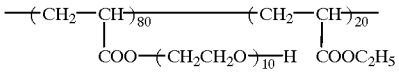
SP-10
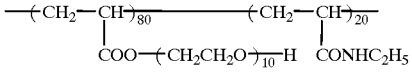
SP-11
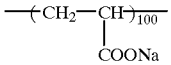
SP-12
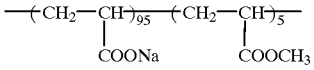
SP-13
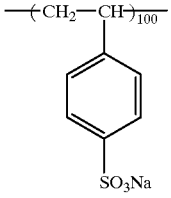
SP-14
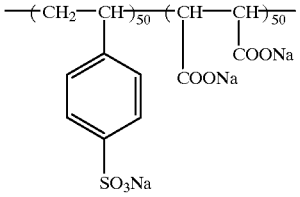
SP-15
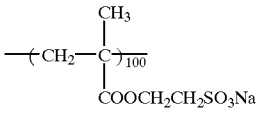
SP-16
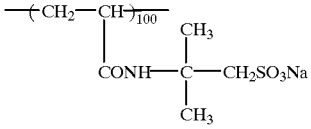
SP-17
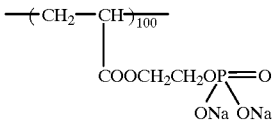
-continued
SP-18
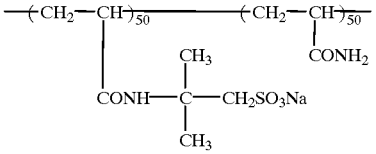
SP-19
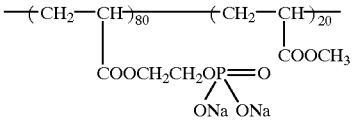
SP-20
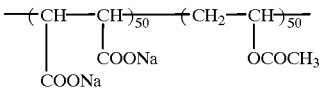
SP-21
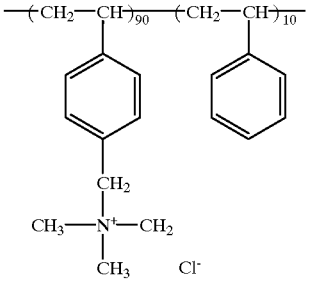
SP-22
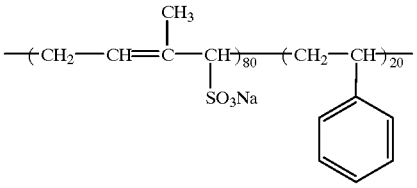
SP-23
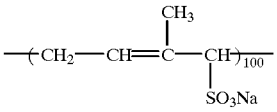
SP-24
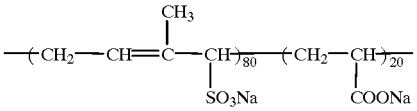
SP-25
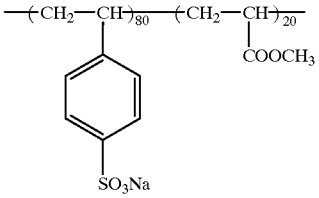

-continued

SP-26

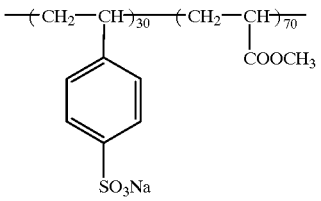

SP-27

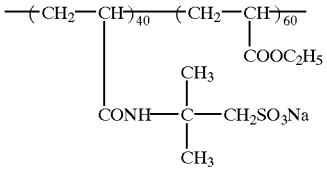

SP-28

Sodium dextransulfate

SP-29

Dextran

SP-30

Sodium alginate

Kind and synthetic method of the monomer and the polymer latex having the active methylene group represented by A of Formula [1] of the present invention are described in U.S. Pat. Nos. 3,459,790, 3,619,195, 3,929,482, 3,700,456, West German Patent No. 2,442,165, European Patent No. 13,147, JP-A Nos, 50-73625, 50-146331.

Tg of polymer is described in detail, for example, in [Polymer Handbook, 2nd Edition, III-139 to III-192 (1975)] edited by J. Brandrup, E. H. Immergut, and Tg of copolymer can be obtained according to the following Formula.

$$1/Tg=a_1/Tg_1+a_2/Tg_2+a_3/Tg_3+\ldots+a_n/Tg_n$$

wherein $Tg_n$:Tg of single polymer derived from monomer n $a_n$:weight percentage of monomer n in polymer $a_1+a_2+a_3+\ldots+a_{n=}1$.

The polymer latex compounds of the present invention are shown below, but are not limited thereto. The composition ratio of each component in copolymer is shown below in Table 1.

TABLE 1

| Compound represented by A of Formula [1] | | Compound represented by B of Formula [1] | | Compound represented by C of Formula [1] | | Protective colloidal compound in emulsion polymerization | |
|---|---|---|---|---|---|---|---|
| Compound | Weight ratio | Compound | Weight ratio | Compound | Weight ratio | (water soluble polymer and/or surfactant) | Synthesizing method of latex |
| MN-1 | 0.1 | BA | 0.45 | St | 0.45 | SP-22, S-2 | Method (1) |
| MN-1 | 0.2 | BA | 0.3 | St | 0.5 | SP-22, S-2 | According to method (1) |
| MN-1 | 0.2 | BA | 0.3 | CHMA | 0.5 | SP-22, S-2 | According to method (1) |
| MN-1 | 0.2 | BA | 0.3 | CHMA | 0.45 | SP-22, S-2 | According to method (1) |
| | | | | AA | 0.05 | | |
| MN-1 | 0.1 | AIN | 0.3 | CHMA | 0.6 | SP-22, S-2 | According to method (1) |
| MN-1 | 0.25 | AIN | 0.25 | CHMA | 0.5 | SP-22, S-2 | Method (2) |
| MN-1 | 0.3 | AIN | 0.3 | CHMA | 0.4 | SP-22, S-2 | According to method (2) |
| MN-1 | 0.25 | EA | 0.35 | EMA | 0.4 | SP-22, S-2 | According to method (2) |
| MN-1 | 0.25 | EA | 0.35 | St | 0.4 | SP-22, S-2 | According to method (2) |
| MN-2 | 0.25 | BA | 0.45 | EMA | 0.3 | SP-22, S-2 | According to method (2) |
| MN-1 | 0.2 | AIN | 0.3 | St | 0.5 | SP-22, S-2 | According to method (2) |
| MN-1 | 0.2 | AIN | 0.3 | St | 0.5 | SP-28, S-2 | Method (3) |
| MN-1 | 0.2 | AIN | 0.3 | St | 0.5 | SP-1, S-2 | According to method (3) |
| MN-1 | 0.2 | AIN | 0.3 | St | 0.5 | SP-2, S-2 | According to method (3) |
| MN-1 | 0.2 | AIN | 0.3 | St | 0.5 | SP-6, S-2 | Method (4) |
| MN-1 | 0.2 | AIN | 0.3 | St | 0.5 | SP-7, S-2 | According to method (3) |
| MN-1 | 0.2 | AIN | 0.3 | St | 0.5 | SP-8, S-2 | Method (5) |
| MN-1 | 0.2 | AIN | 0.3 | St | 0.5 | SP-13, S-2 | Method (6) |
| MN-1 | 0.2 | AIN | 0.3 | St | 0.5 | SP-25, S-2 | According to method (3) |
| MN-1 | 0.2 | AIN | 0.3 | St | 0.5 | SP-26, S-2 | According to method (3) |

S-2 means sodium dodecylbenzenesulfonate

In the emulsion polymerization, polymerization initiator, concentration, polymerization temperature and reaction time can be widely changed according to an intended object. Further, the emulsion polymerization may be carried out in such a way in which all amount of monomer, surfactant, water soluble polymer and medium is previously added in a reaction vessel, thereafter polymerization initiator is added, as occasion demands, the polymerization may be carried out while part or all of amount of each component is being dropped.

Hereon, BA is n-butylacrylate, St is styrene, AA is acrylic acid, EA is ethylacrylate, EMA is ethylmethacrylate, AIN is iso-nonylacrylate, and CHMA is cyclohexylmethacrylate.

The polymer latex of the present invention is preferably contained in one or more layer(s) of a light-sensitive emulsion layer or a non-lightsensitive layer of the silver halide color photographic light-sensitive material. In cases where the polymer latex is contained in the silver halide light-sensitive material, an adding amount of said polymer latex is 10 wt % to 150 wt % to an amount of gelatin binder used in a layer containing said polymer latex, preferably 15 wt % to 100 wt %. Content of the polymer latex is the content of solid component. The most preferable active methylene monomers are MN-1 and MN-2. The order of preferable water soluble polymer is anion polymer, natural polymer and nonion polymer.

(Light-sensitive material)

The silver halide photographic light-sensitive material containing the latex having the active methylene group is explained below. As a binder used in the silver halide emulsion layer and other hydrophilic colloidal layer of the present invention, gelatin is used, but hydrophilic colloid other than gelatin can be used in combination with gelatin. Exemplarily, are used gelatin derivative; grafted polymer of gelatin with other high molecular compound; protein such as albumin and casein, etc.; cellulose derivetives such as hydroxyethylcellulose, carboxymethylcellulose, cellulose-sulfric acid ester, etc.; saccharide derivatives such as sodium alginate, cellulosesulfric acid ester, dextrin, dextran, dextransulfric acid salt, etc.; various kinds of synthesized hydrophilic high molecular compounds which are single polymers or copolymers such as polyvinylalcohol, polyvinyl alcohol partial acetal, poly-N-vinylpyrrolidone, polyacrylic acid, polymethacrylic acid, polyacrylamide, polyvinylimidazole, polyvinylpyrazole, etc. Gelatin includes limed gelatin, acid processed gelatin, gelatin hydrolysate or enzyme decomposed gelatin.

The active methylene latex of the present invention produced in an aqueous solution containing active methylene latex and water soluble polymer through emulsion polymerization is used in hydrophilic colloidal layer, and in cases where the active methylene latex is added to the hydrphilic colloidal binder such as gelatin, improvement of layer strength and water-resisting quality is found and no or extremely small unpreferable affection in photographic characteristics, when the active methylene latex was used in combination with the silver halide emulsion, is found and sensitivity and fog are scarecely influenced, compared with conventional active methylene latex. On the other hand, pH dependence of the coating solution comprising the polymer latex dispersion of the invention is very small when manufacturing the light-sensitive material, and since the polymer latex dispersion of the invention is hardly influenced by ion strength, coagulation or precipitation of the polymer latex hardly occurs. That the active methylene latex of the invention has the above-mentioned characteristics is considered due to the production through emulsion polymerization in the presence of the water soluble polymer as a protective colloid in stead of the presence of only surfactant which is a conventional monomeric compound.

The silver halide grains contained in the silver halide emulsion according to the invention may comprise silver bromide, silver iodobromide, silver iodochloride, silver chlorobromide, silver chloroiodobromide or silver chloride, etc. Of these silver halides are preferred silver iodobromide, silver chloroiodobromide and silver chloride.

With regard to the form of the silver halide grains used in the invention, it may be cube, octahedron, tetradecahedron, spherical form, tabular form or potato form etc. Of these are preferred tabular grains.

As a typical example of the silver halide grain preferably used in the invention, the tabular grain will be explained below. Preferable tabular grains used in the invention are one whose major plane is composed of (111) plane and further having plural parallel twin planes or one whose major plane is composed of (100).

An average value of the ratio (average aspect ratio) of grain diameter/thickness (aspect ratio) of the tabular silver halide grain employed in the present invention is not less than 2. The average aspect ratio is preferably between 2 and 12 and more preferably between 3 and 8.

The exterior wall of the above-mentioned tabular silver halide crystal may be substantially composed almost of a {111} plane or {100} plane, or may be composed of {111} and {100} planes in combination. In this case, the grain surface area is composed of the {111} plane of not less than 50 percent, more preferably the {111} plane between 60 and 90 percent, and most preferably the {111} plane between 70 and 95 percent. The planes other than the {111} plane are preferably composed mainly of the {100} plane. A plane ratio can be obtained by utilizing the difference in adsorption of a sensitizing dye onto the {111} plane and the {100} plane (refer to T. Tani, J. Imaging Sci., Volume 29, page 165 (1985)).

The tabular silver halide grains employed in the present invention may be either polydispersed grains or monodispersed grains, but the monodispersed grains are preferred. Specifically, when a distribution width is defined employing a relative standard deviation (variation coefficient) represented by (standard deviation of grain diameter/average grain diameter)×100=grain diameter distribution width (%), grains with not more than 25% are preferred, those with not more than 20% are more preferred, and those with not more than 15% are most preferred.

The tabular silver halide grains used in the invention are preferably those having a narrow grain thickness distribution. Thus, a width of grain thickness distribution, defined as below, is preferably 25% or less, more preferably 20% or less and furthermore preferably 15% or less:

(Standard deviation of grain thickness/average grain thickness)×100=width of grain thickness distribution (%).

A narrow hlogen content distribution of each grain of the tabular silver halide grains used in the invention is preferable. Thus, a hlogen content distribution, defined as below, is preferably 25% or less, more preferably 20% or less and furthermore preferably 15% or less:

(Standard deviation of halogen content/average halogen cintent)×100=width of halogen content ratio (%).

The tabular silver halide grain having the twin planes employed in the present invention is preferably hexagonal. The hexagonal tabular silver halide grain (hereinafter referred to as hexagonal tabular grain) is that the shape of the major faces ({111} face) is hexagonal and the maximum adjacent edge ratio is between 1.0 and 2.0. The maximum adjacent edge ratio herein is a ratio of the maximum edge length of the hexagon to the minimum edge length. In the present invention, if the maximum adjoining side ratio is between 1.0 and 2.0, the corner may be round. When the corner is round, the length of a side is represented by the length between intersecting points of an extending the straight portion and also extending the straight portions of the adjoining sides. Furthermore, a tabular silver halide grain forming nearly a round tabular grain due to further rounded corner is preferably employed.

In the present invention, regarding each edge forming the hexagon of a hexagonal tabular grain, not shorter than one and half of the edge is preferred to be substantially a straight line. In the invention, the adjacent edge ratio is preferably 1.0 to 1.5.

The silver halide grain employed in the present invention may have dislocation lines. The dislocation can be directly observed by a method employing, at low temperature, a transmission type electron microscope, described in, for example, J. F. Hamilton, Phot. Sci. Eng., Volume 57 (1967)

and T. Shiozawa, J. Soc. Phot. Sci. Japan, 35, 213 (1972). Namely, silver halide grains carefully sampled from an emulsion so that no pressure is applied to cause the dislocation in the grain is placed on a mesh for an electron microscope observation, and is observed under a sample cooling state to minimize damages (print-out, etc.) due to an electron-beam. At this time, the greater the thickness of the grain becomes, the less an electron beam is transmitted. Thus by employing a high voltage type (not less than 200 kV for a grain having a thickness of 0.25 μm) electron microscope, clear observation can be carried out.

Regarding the number of dislocations of the silver halide grains employed in the present invention, grains having one or more dislocation account for preferably not less than 50 percent of the total grains (based on the number of grains) and the more ratio of the number of tabular grains having dislocation, the more preferable.

In the present invention, the grain diameter is the diameter of a circle having the same area as that of a grain projection image. The grain projection area can be obtained employing the sum of this grain area. The above data can be obtained by observing, with an electron microscope, a silver halide crystal sample in which crystals are distributed so that any crystal is overlapped with others.

The average projection area diameter of the tabular silver halide grain employed in the present invention is represented by the diameter of a circle having the same area as the above-mentioned grain projection area, and is preferably not less than 0.30 μm; more preferably between 0.30 and 5 μm; and most preferably between 0.40 and 2 μm. The grain diameter is obtained by enlarging the above-mentioned grain 10,000 to 70,000 times employing an electron microscope and measuring the projection area on the print.

Furthermore, an average diameter ($\phi i$) is obtained by the following formula, wherein n represents the number of measured grains, and ni represents a grain frequency having the grain diameter $\phi i$.

Average diameter ($\phi i$)=$\Sigma nidi/n$ (the number of measured grains is randomly set at not less than 1,000.)

The thickness of a grain can be obtained by obliquely observing a sample. The preferred thickness of the tabular grain employed in the present invention is between 0.03 and 1.0 μm, and more preferably between 0.05 and 0.5 μm.

The ratio of the longest distance (a) between at least two of parallel twin planes in the silver halide grain to the thickness (b) of the grain, (b/a), is preferably not less than 5, and the number ratio of the grains having the above-mentioned ratio of not less than 5 of the total is preferably not less than 50 percent. In the present invention, the average value of (a) is preferably not less than 0.008 μm, more preferably not less than 0.010 μm to not more than 0.05 μm. And in the present invention, at the same time (a) is in the above-mentioned range, it is necessary that a variation coefficient is not more than 35 percent, preferaly not more than 30 percent.

Furthermore, in the present invention, taking the factors of the aspect ratio and the grain thickness into account, a planarity represented by the following formula, A=ECD/b2 is preferably not less than 20. Herein, ECD is an average projection diameter (μm) of the tabular grains and (b) is the thickness of the grain. The average projection diameter represents an number average of a diameter of circle having the same area as a projected area of the tabular grain.

The tabular silver halide grain employed in the present invention may has a uniform composition. However, a silver halide light-sensitive emulsion layer may be comprised of grains having a core/shell type structure comprising at least two layers with a substantially different halogen composition in the silver halide grain. The silver halide light-sensitive emulsion layer preferably contains not less than 50 percent of the core/shell type structure grains in number, more preferably 100 percent.

The core/shell type structure grain occasionally contains a silver halide composition region different from the core in center of the grain. In the above-mentioned case, a halogen composition of a seed grain may be optionally in combination of silver bromide, silver iodobromide, silver chloroiodobromide, silver chlorobromide and silver chloride, etc.

An average content ratio of silver iodide of the silver halide emulsion according to the present invention is preferably not more than 2 mole percent, more preferably 0.01 to 1.0 mole percent. In said grain having the structure of layers comprising different halogen composition, it is preferable that a layer of high content ratio of silver iodide is contained in the interior of the grain and a layer of low content ratio of silver iodide or a layer of silver bromide is contained in the outermost surface of the grain. In this case, the content ratio of silver iodide in the interior layer of the grain (core) having maximum silver iodide content ratio is not less than 2.5 mole percent, more preferably not less than 5 mole percent, and the content ratio of silver iodide in the outermost surface of the grain (shell) is 0 to 5 mole percent, preferably 0 to 3 mole percent. The content ratio of silver iodide in the core is preferably more than that in the shell by not less than 3 mole percent.

The distribution of silver iodide in the core is usually uniform, but occasionally silver iodide in the core is distributed. For example, higher concentration portion of silver iodide may exist at a farther point from the center of the grain, and maximum or minimum concentration portion of silver iodide may exist in an intermediate region of the core.

The silver halide grain employed in the present invention may be a so-called halogen conversion type grain. A halogen conversion amount is preferably between 0.2 and 2.0 mole percent of silver. The conversion may be carried out during physical ripening or after the completion of the physical ripening. As a halogen conversion method, an aqueous halogen solution or fine silver halide grains having less solubility product than the halogen composition on the grain surface prior to the halogen conversion are generally added. At the time, the fine grain size is preferably not more than 0.2 μm and more preferably between 0.02 and 0.1 μm.

The silver halide grain, employed in the present invention, is preferably grown in such a manner that silver halide is deposited on a seed crystal as a method described in, for example, JP-A No. 60-138538.

In preparing the emulsion according to the invention, forming process of seed grain and growing process of seed grain can be conducted in the presence of known silver halide solvents such as ammonia, thioether and thiourea, etc.

In order to prepare the tabular silver halide grains employed in the present invention, as conditions to grow the prepared seed grains, as described in, for example, JP-A Nos. 51-39027, 55-142329, 58-113928, 54-48521, and 58-49938, a water-soluble silver salt solution and a water-soluble halide solution are added employing a double-jet method and a method may be employed in which the rate of addition is gradually varied in the range such that no new nucleus is formed in accordance with the grain growth and no Ostwald ripening occurs. As another condition to enlarge the seed grains, as is described in Item 88 of Abstract Collection of 1983 Annual Meeting of Japan Photographic Society, a method may be employed in which grains are enlarged by adding fine silver halide grains to be allowed to dissolve and recrystallize.

Upon growing grains, an aqueous silver nitrate solution and an aqueous halide solution may be added employing a double-jet method, but halide and silver may be supplied to a system in the form of silver halide. The rate of addition is a rate at which a new nucleus is not generated and no broadening of a size distribution occurs due to Ostwald ripening, that is, addition is preferably carried out in the 30 to 100% range of the rate of new nucleus formation.

Upon preparing the silver halide emulsion of the present invention, stirring conditions during preparation are extremely important. As a stirring device, the device disclosed in JP-A No. 62-160128 is preferably employed in which an addition liquid nozzle is arranged, in a liquid, near a mother liquid sucking hole of the stirrer. Furthermore, in this case, the stirring rotation number is preferably set at 400 to 1,200 rpm.

The silver iodide content ratio and average silver iodide content ratio of silver halide grains employed in the present invention can be measured employing an EPMA method (Electron Probe Micro Analyzer). In this method, a sample is prepared in which emulsion grains are well dispersed so that the grains are not in contact with each other, and an element analysis for a micro part is carried out employing an X-ray analysis utilizing an electron beam excitation generated by electron beam irradiation. Employing this method, the halogen composition of each grain can be determined by measuring characteristic X-ray intensities of silver and iodide radiated from each grain. With at least 100 grains, the average silver iodide content ratio of each grain is obtained employing the EPMA method and the average silver iodide content ratio is then calculated.

Furthermore, during the grain forming process and/or grain growth process, the silver halide grains employed in the present invention may be subjected to incorporation of at least one metal ion selected from cadmium salts, zinc salts, thallium salts, iridium salts (including the complexes), and iron salts (including the complexes) in the grain interior and/or the grain surface layer, and further may be subjected to formation of reduction sensitization nuclei in the grain interior and/or the grain surface, while being placed in reduction environment. And, at the desired time, oxidizing agents such as hydrogen peroxide and thiosulfonic acid can be added.

The silver halide emulsion of the silver halide light-sensitive photographic material of the present invention may be subjected to removal of unnecessary salts after the completion of silver halide grain growth or retention of the salts. The removal of the above-mentioned salts can be carried out employing methods described in Research Disclosure (hereinafter referred to as RD) Item 17643 Section II.

Further, the silver halide emulsion layer employed in the present invention may comprise various shapes of grains as far as the effects of the present invention are not degraded.

The silver halide used in the silver halide photographic light-sensitive material of the present invention may be sensitized by various types of sensitizing methods. Examples of spectral sensitizing dyes include a cyanine dye, a merocyanine dye, a complex cyanine dye, a complex merocyanine dye, a holopolar cyanine dye, a hemi-cyanine dye, a styryl dye and a hemioxonol dye. Of these dyes are useful a cyanine dye, merocyanine dye and a complex merocyanine dye. To these dyes are applicable any one of nuclei conventionally used, including a pyrroline nucleus, an oxazoline nucleus, a tiazoline nucleus, a pyrrol nucleus, an oxazole nucleus, a thiazole nucleus, a selenazole nucleus, an imidazole nucleus, a tetrazole nucleus and a pyridine nucleus. There are also applicable nuclei in which the nucleus described above is condensed with an aliphatic hydrocarbon ring, including an indolenine nucleus, a benzindolenine nucleus, an indole nucleus, a benzoxazole nucleus, a naphthooxazole nucleus, a benzothiazole nucleus, naphthothiazole nucleus, benzoselenazole nucleus, benzimidazole nucleus and quinoline nucleus. These nuclei may be substituted.

In the merocyanine dye and complex merocyanine dye, a nucleus having a ketomethine structure is applicable, including 5 or 6-membered heterocyclic nucleus such as a pyrazoline-5-one nucleus, a thiohydantoin nucleus, a 2-thiooxazolidine-2,4-dione nucleus, a thiazoline-2,4-dione nucleus, a rhodanine nucleus and a thiobarbituric acid nucleus.

The dyes are described in German Patent 929,080; U.S. Pat. Nos. 2,231,658, 2,493,748, 2,503,776, 2,519,001, 2,912,329, 3,655,394, 3,656,959, 3,672,897 and 3,649,217; British Patent 1,242,588 and Japanese Patent Examined Publication No. 44-14030.

Furthermore, a dye having no spectral sensitization capability or a compound having no absorption in the visible region which shows supersensitization used in combination with these spectral sensitizing dyes may be added in the emulsion.

The adding amount of the spectral sensitizing dye, depending on the kind of the dye, and structure, composition, ripening conditions, objectives and uses of silver halide, is preferably in such an amount as to be 40 to 90% of monomolecular layer coverage, and more preferably, 50 to 80%.

The monomolecular layer coverage refers to a relative value, based on that, when absorption isotherm at 50° C. is prepared, a saturated absorbing amount is 100% of the coverage.

The optimal amount of the spectral sensitizing dye, which is variable, depending on the total surface area of silver halide grains contained in an emulsion, is less than 600 mg and preferably less than 450 mg per mol of silver halide.

As a solvent for the sensitizing dye are usable conventionally employed water-miscible organic solvents, including alcohols, ketones, nitrites, and alkoxyalcohols. examples thereof include methanol, ethanol, n-propyl alcohol, isopropyl alcohol, ethylene glycol, propylene glycol, 1,3-propanediol, acetone, acetonitrile, 2-methoxyethanol and 2-ethoxyethanol.

Surfactants have been conventionally employed as a dispersing agent. In the invention is also usable any type of surfactants, including an anionic type, cationic type, non-ionic type and amphoteric type.

According to the invention, advantageous effects are enhanced by adding the sensitizing dye in the form of a solid fine particle dispersion rather than in the form of an organic solvent solution. At least one sensitizing dye is preferably added in the form of scarcely water-soluble, solid fine particles dispersed in water substantially free from an organic solvent and/or surfactant.

In the present invention, solubility in water of the sensitizing dye used in the form of the solid fine particle dispersion is preferably $2\times10^{-4}$ to $4\times10^{-2}$ mol/l, and more preferably $1\times10^{-3}$ to $4\times10^{-2}$ mol/l. The solubility of the sensitizing dye can be determined in accordance with the following procedure.

To a conical flask with a volume of 50 ml was added deionized water of 30 ml, a dye was added thereto in excess of soluble amounts and stirred with a magnetic stirrer for 10 min., while maintaining a temperature of 27° C. in a thermostat. The suspension was filtered through filter paper No. 2 (available from Toyo Corp.), and the filtrate was filtered through disposable filter (available from Toso Corp.), then optimally diluted and the absorbance thereof was measured by a spectrophotometer U-3410 (available from Hitachi Corp.). From the measurement result, the solution concentration was determined in accordance with Beer-Lambert law to determine the solubility, as follows:

$D=\epsilon lc$ where D is absorbance, $\epsilon$ is extinction coefficient, l is a length of an absorption measuring cell, and c is a concentration (mol/l).

The sensitizing dye used in the invention can be added in the process of chemical sensitization, preferably at the start of chemical sensitization. Addition of the dye during the course of nucleation of a silver halide emulsion to completion of desalting process results in a sensitive silver halide emulsion with enhanced spectral sensitization efficiency. Furthermore, the same dye as added in the aforesaid processes (from the nucleus forming process to the completion of desalting process) or other kind of a spectral sensitizing dye can be additionally added in any process from the completion of desalting process through chemical ripening process to just before coating process.

Selenium sensitizers usable in the chemical sensitization according to the present invention include a variety of selenium compounds, as described in U.S. Pat. Nos. 1,574,944, 1,602,592 and 1,623,499; and JP-A 60-150046, 4-25832, 4-109240 and 4-147250. Examples thereof include colloidal selenium metal, isoselenocyanates (e.g., allylisoselenocyanate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid, methyl-3-selenobutylate), selenophosphates (tri-p-triselenophosphate), and selenides (e.g., triphenylphosphine selenide, diethyl selenide, diethyl diselenide). Of these sensitizers, selenides, selenoureas, selenoamides and selenoketones are preferred.

The techniques employing these selenium sensitizers are disclosed in U.S. Pat. Nos. 1,574,944, 1,602,592, 1,623,499, 3,297,466, 3,297,447, 3,320,069, 3,408,196, 3,408,197, 3,442,653, 3,420,670, and 3,591,385; French Patent Nos. 2,693,038 and 2,093,209; Japanese Patent Examined Publication Nos. 52-34491, 52-34492, 53-295, and 57-22090, JP-A Nos. 59-180536, 59-185330, 59-181337, 59-187338, 59-192241, 60-150046, 60-151637, 61-246738, 3-4221, 3-24537, 3-111838, 3-116132, 3-148648, 3-237450, 4-16838, 4-25832, 4-32831, 4-96059, 4-109240, 4-140738, 4-140739, 4-147250, 4-184331, 4-190225, 4-191729, and 4-195035, U.K. Patent Nos. 255,846 and 861,984; and H. E. Spencer, et al, Journal of Photographic Science, Volume 31, pages 158 to 169 (1983).

The amount of the selenium sensitizer to be used, depending on a selenium compound, silver halide grains and chemical ripening conditions, is generally $10^{-8}$ to $10^{-4}$ mol per mol of silver halide. Adding methods include, a method of adding the selenium compound solubilized, depending on the property of the selenium compound, in single or combined solvent of water or organic solvent such as methanol, ethanol, a method of adding the selenium compound previously mixed with gelatin aqueous solution, and a method of adding the selenium compound in an emulsion dispersion form of mixed solution with organic solvent miscible polymer described in JP-A No. 4-140739.

The temperature of chemical sensitization with the selenium sensitizer is preferably 40 to 90° C. and more preferably 45 to 80° C. The pH and pAg is preferably 4 to 9 and 6 to 9.5, respectively.

Tellurium sensitizer and its sensitization method used in the present invention is disclosed in U.S. Pat. Nos. 1,623,499, 3,320,069, 3,772,031, 3,531,289 and 3,655,394; British Patents 235,211, 1,121,496, 1,295,462 and 1,396,696; Canadian patent 800,958; and JP-A 4-204640 and 4-333043. Examples of useful tellurium sensitizers include telluroureas (e.g., N,N-dimethyltellurourea, tetramethyltellurourea, N-carboxyethyl-N,N'-dimethyltellurourea, N,N'-dimethyl-N'-phenyltellurourea), phosphine tellurides (e.g., tributylphosphine telluride, tricyclohexylphosphine telluride, triisopropylphosphine telluride, butyl-diisopropylphosphine telluride, dibutylphenylphosphine telluride), telluroamides (e.g., telluroacetoamide, N,N-dimethyltellurobenzamide), telluroketones, telluroesters and isotellurocyanates. Using technique of the tellurium sensitizer follows that of the selenium sensitizer.

In the present invention, reduction sensitization is preferably used in combination. Said reduction sensitization is preferably conducted during the growth of the silver halide grain. The methods conducted during the growth include not only a method of the reduction sensitization conducted while the silver halide grain being grown, but also a method of the reduction sensitization conducted while the silver halide grain growth being intermitted, followed by growth of the silver halide grain subjected to the reduction sensitization.

In the present invention, the silver halide grain can be sensitized by the selenium compounds and the tellurium compounds, but further it can be sensitized by sulfur compounds and noble metal salts such as gold salt. Furthermore it can be sensitized by the reduction sensitization and in combination of these sensitization methods.

In the present invention, sulfur sensitizers may be employed which are described in U.S. Pat. Nos. 1,574,944, 2,410,689, 2,278,947, 2,728,668, 3,501,313, and 3,656,955; West German OLS Patent No. 1,422,869; JP-A Nos. 56-24937 and 55-45016, etc. In the sulfur sensitization, may be preferably employed sulfur compounds such as thiourea derivatives such as 1,3-diphenylthiourea, triethylthiourea, 1-ethyl-3-(2-thiazolyl)-thiourea, rhodanine derivatives, dithiacarbamine acids, polysulfido organic compounds, sulfur monomer, etc. Further, the sulfur monomer preferably includes $\alpha$-sulfur belonging to an orthorhombic crystal system.

Examples of gold sensitizers include chloroauric acid, gold thiosulfate, gold thiocyanate, and gold complexes of various compounds such as thioureas and rhodanines. The amount of the sulfur sensitizer and the gold sensitizer to be used is, depending on the kinds of the silver halide emulsion, the kinds of used compounds and chemical ripening conditions, is generally preferably $10^{-4}$ to $10^{-9}$ mol per mol of silver halide, more preferably $10^{-5}$ to $10^{-8}$ mol per mol.

In the present invention, the sulfur sensitizer and the gold sensitizer can be incorporated through solution in water, alcohols, or organic or inorganic solvents, or incorporated in the form of a dispersion employing water-insoluble solvents or a medium such as gelatin.

In the present invention, the sulfur sensitization and the gold sensitization can be simultaneously applied, or separately and stepwise applied. In the latter case, after the sulfur sensitization is appropriately applied or in course of the sulfur sensitization, the gold sensitization is applied so as to obtain preferred result.

The reduction sensitization is conducted by adding a reducing agent and/or water soluble silver salt to the silver halide emulsion so that the reduction sensitization is conducted during the silver halide grain growth of the silver halide emulsion.

Preferable examples of the reducing agents include thiourea dioxide and ascorbic acid and their derivatives. Another preferable examples of the reducing agents include hydrazine, polyamine derivative such as diethylenetriamine, dimethylamineborane derivative and sulfites, etc.

An adding amount of the reducing agent is preferably varied according to the kinds of the reduction sensitizing agent, grain size of the silver halide grain, composition and crystal habit of the silver halide grain, reaction temperature, pH, pAg, etc. For example, in the case of thiourea dioxide, the adding amount of 0.01 to 2 mg per 1 mol of silver halide brings preferred result. In the case of ascorbic acid, the adding amount of 50 mg to 2 g per 1 mol of silver halide is preferred.

Preferable reduction sensitization condition includes temperature of about 40 to 70° C., time of about 10 to 200 minutes, pH of about 5 to 11, and pAg of about 1 to 10 (herein, pAg value is a reciprocal of $Ag^+$ ion concentration).

As a water soluble silver salt, silver nitrate is preferred. By adding the water soluble silver salt, so-called silver ripening is conducted which is one kind of the reduction sensitizing technique. pAg of the silver ripening is suitably 1 to 6, more suitably 2 to 4. As the condition of temperature, pH and time, the above-mentioned reduction sensitization condition is preferred. As a stabilizer of the silver halide photographic emulsion containing the silver halide grains subjected to the reduction sensitization of the invention, later mentioned general stabilizer can be used, but in combined usage with an antioxidant described in JP-A No. 57-82831 and/or thiosulfonic acid derivatives described in V. S. Gahler, [Zeitshrift fur wissenschaftliche Photographie Bd. 63, 133 (1969)] and JP-A 54-1019, excellent results are often obtained. Addition of these compounds may be conducted in any process of emulsion manufacturing process after crystal growth process until adjusting process just before coating.

In the present invention, fine particle silver halide grains can be added in any process after chemical ripening process until coating process.

For the purposs of accelerating adsorption of a spectral sensitizing dye to the silver halide grains, the fine silver iodide grains may be added during any process from chemical ripening to the period just before coating, but are preferably added during the chemical ripening. The chemical ripening process refers to a process from the time when physical ripening and a salt removal operation of the emulsion of the present invention are completed to the time when an operation is conducted to terminate the chemical ripening. Furthermore, the fine silver iodide grains may be intermittently added several times, and after the addition of the fine silver iodide grains, another chemical-ripened emulsion may be added. When the fine silver iodide grains are added, the temperature of the emulsion in a liquid state is preferably in the range of 30 to 80° C. and more preferably in the range of 40 to 65° C. The fine silver iodide grains is preferably added in a manner in which part or all of it disappears after addition of it until coating, and it is more preferable that not less than 20% of added fine silver iodide grains disappears just before coating.

A bleachable or leachable dye may be contained in any optional at least one layer cinstituting a silver halide emulsion containing layer or a layer other than the silver halide emulsion containing layer. In this case, the light-sensitive material with high sensitivity, high sharpness and less dye stain can be obtained. The dye used in the light-sensitive material is appropriately selected from dyes capable of enhancing sharpness to remove undesired influence caused by light wavelength by absorbing the wavelength. It is preferable that the dye bleaches or leaches during developing process and when an image is formed, no stain is visually recognized.

Examples of dyes used in the light-sensitive material of the present invention are described in German patent 616,007; British Patents 584,609 and 1,177,429; Japanese Patent Examined Publication No. 26-7777, 39-22969 and 54-38129; JP-A 48-85130, 49-99620, 49-114420, 49-129537, 50-28827, 52-108115, 57-185038, 2-282244 and 4-307539; U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3094,418, 3,125,448, 3,148,187, 3,177,078, 3,247,127, 3,260,601, 3,282,699, 3,409,433, 3,549,887, 3,575,704,3,653905, 3,718,472, 3,865,817, 4,070,352 and 4,071,312; PB Report No. 74175; and PHOTO. ABS. 1, 28.

The dye may be added in any constituting layer. That is, the dye may be added in at least one layer such as a light-sensitive emulsion layer, or other hydrophilic colloidal layer coated on the same side as said light-sensitive emulsion layer (for example, non-lightsensitive layer such as an intermediate layer, a protective layer, a sublayer). The dye is preferably contained in either a silver halide emulsion layer or a layer closer to a support, or contained in both layers, more preferably contained in a layer adjacent to a transparent support. The concentration of the dye is prefarably higher in the layer closer to the support.

In the present invention, an adding amount of the above-mentioned dye is variable according to an intended object of sharpness, but is preferably 0.2 $mg/m^2$ to 20 $mg/m^2$, more preferably 0.8 $mg/m^2$ to 15 $mg/m^2$.

The above-mentioned dye can be incorporated into a hydrophilic colloidal layer in an usual manner, namely, an appropriate concentration of aqueous solution of the dye or a solid fine particle dispersion of the dye can be incorporated. JP-A Nos. 1-158430, 2-115830, 4-251838 can be referred.

In cases where the silver halide emulsion layer is dyed, the dye is incorporated into a silver halide emulsion solution prior to coating or into an aqueous solution of hydrophilic colloid, then these solutions may be coated directly or through other hydrophilic colloidal layer on the support in various coating manners.

As mentioned above, it is preferred that the concentration of the dye is prefarably higher in the layer closer to the support, therefore, in order to fix the dye in the layer closer to the support, a mordant can be applied. For example, nondiffusing mordant which bonds with at least one kind of the aforesaid dyes can be used. Examples of the nondiffusing mordant are described in in German patent No. 2,263,031, British patent Nos. 1,221,131, 1,221,195, JP-A Nos. 50-47624, 50-71332, Japanese Patent Examined Publication No. 51-1418, U.S. Pat. Nos. 2,548,564, 2,675,316, 2,795,519, 2,839,401, 2,882,156, 3,048,487, 3,184,309, 3,444,138, 3,445,231, 3,706,563, 3,709,690, 3,788,855.

Bonding the nondiffusing mordant with the dye is carried out in known various manners in this art, specifically, bonding in gelatin powder is usually employed. Otherwise, after bonding in an appropriate binder, then thus obtained binder is dispersed in aqueous gelatin solution employing an ultrasonic homogenizer.

Bonding ratio is not constant depending on compounds, but usually 0.1 to 10 parts of the nondiffusing mordant bonds with 1 part of a water soluble dye. Using amount of the water soluble dye in combination with the nondiffusing mordant can be more than that of the singly used water soluble dye.

In cases where the dye bonded with the nondiffusing mordant is contained in the light-sensitive material, a constituting layer containing the dye bonded with the nondiffusing mordant is newly provided, but it is preferable that said layer is a coating layer adjacent to the support.

A variety of photographic adjuvants can be employed in the photographic material relating to the invention. The known adjuvants include compounds described in Research Disclosure No. 17643 (1978, December), ibid No. 18716 (1979, November), and ibid No. 308119 (1989, December). Below, compounds disclosed in these three references and locations thereof are given.

| | [RD-17643] | | [RD-18716] | [RD-308119] | |
|---|---|---|---|---|---|
| | Page | Category | Page | Page | Category |
| Chemical sensitizer | 23 | III | 648 upper right | 996 | III |
| Sensitizing dye | 23 | IV | 648–649 | 996–998 | III |
| Desensitizing dye | 23 | IV | | 998 | B |
| Dye | 25–26 | VIII | 649–650 | 1003 | VIII |
| Development accelerator | 29 | XXI | 648 upper right | | |
| Anti-foggant, Development inhibitor | 24 | IV | 649 upper right | 1006–1007 | VI |
| Brightening agent | 24 | V | | 998 | V |
| Surfactant | 26–27 | XI | 650 right | 1005–1006 | XI |
| Anti-static agent | 27 | XII | 650 right | 1006–1007 | XIII |
| Plasticizer | 27 | XII | 650 right | 1006 | XII |
| Lubricant | 27 | XII | | | |
| Matting agent | 28 | XVI | 650 right | 1008–1009 | XVI |
| Binder | 26 | XXII | | 1003–1004 | XXII |
| Support | 28 | XVII | | 1009 | XVII |

An appropriate support is a plastic film on whose surface is provided with a sublayer and whose surface is subjected to corona discharge and ultraviolet ray irradiation to improve adhesiveness.

As a support used in the silver halide photographic light-sensitive material of the present invention, one described in the above-mentioned RD is cited, but an appropreate support is a plastic film on whose surface is provided with a sublayer and whose surface is subjected to corona discharge and glow discharge to improve adhesiveness. On both surface of thus obtained support can be coated the emulsion according to the invention.

To the silver halide photographic light-sensitive material, if necessary, is applicable an antihalation layer, an intermediate layer, a filter layer, etc.

In the photographic light-sensitive material of the present invention, a photographic layer and other hydrophilic colloidal layer can be coated on the support or other layer in various coating manners. Methods of coating include a dip coating method, a roller coating method, a curtain coating method, an extrusion coating method and a slide hopper coating method, etc. The methods described in Research Disclosure, vol. 176, p. 27 to 28, [Coating procedures] can be usable.

In the silver halide photographic light-sensitive material of the present invention, a developing agent such as aminophenol, ascorbic acid, pyrocatecol, hydroquinone, phenylenediamine or 3-pyrazolidone may be contained in the emulsion layer or other layers.

Next, preferable developing process for the light-sensitive material of the present invention will be explained. The developing method for the light-sensitive material of the present invention is not limited to black and white development or color development. Examples of developing agents used in a developing solution include dihydroxybenzene derivative such as hydroquinone; p-aminophenol derivative such as p-aminophenol, N-methyl-p-aminophenol, 2,4-diaminophenol; 3-pyrazolidone derivative such as 1-phenyl-3-pyrazolidone, 1-phenyl-4-methyl-4-hydroxy-3-pyrazolidone, 5,5-dimethyl-1-phenyl-3-pyrazolidone; described in JP-A Nos. 4-15641, 4-16841, and these are preferably used in combination.

Preferable using amount of the above-mentioned p-aminophenol derivative and 3-pyrazolidone derivative is 0.004 mol/l, more preferable is 0.04 to 0.12 mol/l.

The total mol of dihydroxybenzene derivative, p-aminophenol derivative, 3-pyrazolidone derivative contained in total compositions constituting the developing solution is preferably not more than 0.1 mol/l.

Examples of preserving agents include sulfite derivative such as potassium sulfite, sodium sulfite; reductone derivative such as piperidinohexose reductone. Using amount of these compounds is preferably 0.2 to 1 mol/l, more preferably 0.3 to 0.6 mol/l. Large using amount of ascorbic acid derivative leads to solution stability.

Examples of alkaline agents include pH adjusting agents such as sodium hydroxide, potassium hydroxide, sodium carbonate, potassium carbonate, sodium phosphate and potassium phosphate. Further, borate described in JP-A No. 61-28708, buffering agent such as saccharose, acetoxime, 5-sulfosalicylic acid, phosphate, carbonate described in JP-A 60-93439. Content of these agents are adjusted so as to obtain pH of 9.0 to 13 of the developing solution, preferably pH of 10 to 12.5.

Examples of solubilizing auxiliary agents include polyethyleneglycol derivative and its ester. As a sensitizing agent, accelerating agent and surfactant sush as quaternary ammonium salt can be contained.

Examples of silver antisludging agents include silver antistaining agent described in JP-A No. 56-106244, sulfido, disulfido compound described in JP-A No. 3-51844, cysteine derivative or triazine derivative described in Japanese Patent Application No. 4-92947.

Examples of organic inhibitors include azole type antifoggant, for example, indazole type, imidazole type, benzimidazole type, triazole type, benztriazole type, tetrazole type and thiadiazole type.

Examples of inorganic inhibitors include sodium bromide, potassium bromide, potassium iodide, etc. Further, the compounds described in L. F. A. Menson, [Photographic Processing Chemistry], published by Focal Press Co., on pages 226 to 229 (1966), U.S. Pat. Nos. 2,193,015, 2,592,364, JP-A No. 48-64933 can be used. Examples of chelating agents to hide calcium ion contained in city water used for a processing solution include organic chelating agent having chelating constant with iron of not less than 8 described in JP-A No. 1-193853. Examples of inorganic chelating agents include sodium hexametha phosphate, potassium hexametha phosphate, polyphosphoric acid salt, etc.

As a development hardener, dialdehyde can be used, and glutaraldehyde is preferably used.

The development processing temperature of the present invention is preferably 25 to 50° C., more preferably 30 to 40° C. The development time is preferably 5 to 90 seconds, more preferably 8 to 60 seconds. The processing time preferably is 20 to 210 seconds from Dry to Dry, more preferably 30 to 90 seconds.

In replenishment in the present invention, exhaustion of the processing agents and oxidized exaustion are replenished. The replenishment based on width and transportation speed described in JP-A NO. 55-126243, the replenishment based on area described in JP-A No. 60-104946, and the replenishment based on area controlled by the sheet number of the light-sensitive material processed continuously described in JP-A No. 1-149156 are preferably conducted, and preferable replenishment amount is 500 to 150 ml/m$^2$.

Preferable fixing agent includes a fixing material known in this art. pH of fixing solution is not lower than 3.8, preferably 4.2 to 5.5. As a fixing agent, is cited thiosulfate such as ammonium thiosulfate, sodium thiosulfate, in point of fixing rate, ammonium thiosulfate is specifically preferred. Concentration of said ammonium thiosulfate is preferably 0.1 to 5 mol/l, more preferably 0.8 to 3 mol/l.

In the fixing solution of the present invention, acidic hardening may be conducted. In this case, as a hardener, aluminium ion is preferably used. For example, aluminium sulfate, aluminium chloride and potash alum, etc. are preferably used.

In the fixing solution of the present invention, if necessary, preserving agents such as sulfite, bisulfite; buffering agents such as acetic acid and boric acid; various kinds of acids such as mineral acid (sulfuric acid, nitric acid), organic acid (citric acid, oxalic acid, malic acid), hydrochloric acid; pH adjusting agents such as metal hydroxide (potassium hydroxide, sodium hydroxide); chelating agents capable of softening hard water can be contained.

As fixing accelerating agents, are cited thiourea derivative described in Japanese Patent Examined Publication Nos. 45-35754, 58-122535, 58-122536, together described in U.S. Pat. No. 4,126,459.

The total development processing time (Dry to Dry) of the light-sensitive material of the present invention is specifically not limited, but in the case of black and white development, ultra rapid processing of not more than 25 seconds can be attained. "Development processing time" or "development time" in the present invention is the period between the extreme point of the light-sensitive material being processed immersing into the developing tank solution of an automatic processor and immersing into the next fixing tank solution. "Fixing time" is the period between the extreme point of the light-sensitive material being processed immersing into the fixing tank solution and immersing into the next washing tank solution (stabilizing solution). "Washing time" is the period while the light-sensitive material being processed immersing in the washing tank solution. "Drying time" is the period while the light-sensitive material being processed existing in drying zone where drying temperature is 35 to 100° C., preferably 40 to 80° C. caused by hot air blow. In the development process of the present invention, the development time is 3 to 15 seconds, preferably 3 to 10 seconds, the development temperature is preferably 25 to 50° C., more preferably 30 to 40° C. The fixing temperature and time are preferably 20 to 50° C. and 2 to 12 seconds respectively, more preferably 30 to 40° C. and 2 to 10 seconds respectively. The washing or stabilizing temperature and time are preferably 0 to 50° C. and 2 to 15 seconds respectively, more preferably 15 to 40° C. and 2 to 8 seconds respectively. According to the method of the present invention, the photographic light-sensitive material processed by development, fixation and washing (stabilizing) is dried after through squeeze roller where the washing water contained in said photographic light-sensitive material is wrung out. Drying is carried out at 40 to 100° C. the drying time is variable depending on the circumstance temperature, usually 3 to 12 seconds, specifically preferably at 40 to 80° C., 3 to 8 seconds. A far infrared ray heater is more preferably employed.

In the present invention, replenishment amount of developing solution and fixing solution is able to be not more than 200 ml per 1 m$^2$ of the silver halide light-sensitive material. Further, to carry out examples of the present invention, various techniques used in the photographic art can be applied.

EXAMPLES

The present invention is further explained based on examples, but embodiments of the present invention are by no means limited to these examples.

Example 1

Synthesizing methods of methylene latexes are shown below.

(Synthesizing example 1)

In a 1 liter three neck distillation flask equipped with a stiirring equipment, a thermometer and a reflux condenser were added 345 ml of distilled water, 14 g of 35 wt % aqueous solution of SP-22 (solid content of SP-22 was 4.9 g) and 0.4 g of 25 wt % aqueous solution of sodium dodecylbenzenesulfonate (S-2) (solid content of S-2 was 0.1 g). To thus obtained solution being heated and stirred at 80° C. under a nitrogen atmosphere was added 30 ml of water in which potassuim persulfate was dissolved in an amount of 1.5 wt % to a total weight of monomers to be added. Immediatly after the addition of potassuim persulfate, to the solution was dropped a mixed solution of 10 g of acetoacetoxyethylmethacrylate, 45 g of butylacrylate and 45 g of styrene taking 1 hour, and after dropping the solution was heated and stirred for 3 hours. Furthermore, 10 ml of water in which potassuim persulfate was dissolved in an amount of 0.5 wt % to a total weight of monomers was added to the above obtained solution, thus obtained solution was heated and stirred for still more 3 hours so as to complete polymerization reaction. Thereafter, the reacted mixture was allowed to cool down to room temperature to obtain [Lx-1]. Polymer latexes [Lx-2 to Lx-5] were also synthesized in the same manner as employed in synthesizing [Lx-1] in monomer composition shown in Table 2.

(Synthesizing example 2)

In the same equipment as employed in synthesizing example 1 were added 345 ml of distilled water, 14 g of 35 wt % aqueous solution of SP-22 (solid content of SP-22 was 4.9 g) and 0.4 g of 25 wt % aqueous solution of S-2 (solid content of S-2 was 0.1 g). To thus obtained solution being heated and stirred at 80° C. under a nitrogen atmosphere was added 30 ml of water in which potassuim persulfate was dissolved in an amount of 1.5 wt % to a total weight of monomers to be added. Immediatly after the addition of potassuim persulfate, to the solution was dropped a mixed solution of 25 g of acetoacetoxyethylmethacrylate, 25 g of iso-nonylacrylate and 50 g of cyclohexylmethacrylate taking 1 hour, and after dropping the solution was heated and stirred for 3 hours. Furthermore, 10 ml of water in which potassuim persulfate was dissolved in an amount of 0.5 wt % to a total weight of monomers was added to the above obtained solution, thus obtained solution was heated and stirred for still more 3 hours so as to complete polymerization reaction. Thereafter, the reacted mixture was allowed to cool down to room temperature to obtain [Lx-6]. Polymer latexes [Lx-7 to Lx-11] were also synthesized in the same manner as employed in synthesizing [Lx-6] in monomer composition shown in Table 2.

(Synthesizing example 3)

In the same equipment as employed in synthesizing example 1 were added 355 ml of distilled water, 4.9 g of SP-28 and 0.4 g of 25 wt % aqueous solution of S-2 (solid content of S-2 was 0.1 g). To thus obtained solution being heated and stirred at 80° C. under a nitrogen atmosphere was added 30 ml of water in which potassuim persulfate was dissolved in an amount of 1.5 wt % to a total weight of monomers to be added. Immediatly after the addition of potassuim persulfate, to the solution was dropped a mixed solution of 20 g of acetoacetoxyethylmethacrylate, 40 g of iso-nonylacrylate and 40 g of styrene taking 1 hour, and after dropping the solution was heated and stirred for 3 hours. Furthermore, 10 ml of water in which potassuim persulfate was dissolved in an amount of 0.5 wt % to a total weight of monomers was added to the above obtained solution, thus obtained solution was heated and stirred for still more 3 hours so as to complete polymerization reaction. Thereafter, the reacted mixture was allowed to cool down to room temperature to obtain [Lx-12]. Polymer latexes [Lx-13 to Lx-20] were also synthesized in the same manner as employed in synthesizing [Lx-12] in monomer composition shown in Table 2 except replacing SP-28 by the water soluble polymers shown in Table 2 in the same amount as that of SP-28.

(Synthesizing example 4)

Polymer latex [Lx-15] was synthesized in the same manner as employed in synthesizing example 3 except replacing SP-28 by SP-6 in synthesizing example 3.

(Synthesizing example 5)

Polymer latex [Lx-17] was synthesized in the same manner as employed in synthesizing example 3 except replacing SP-28 by SP-8 in synthesizing example 3.

(Synthesizing example 6)

Polymer latex [Lx-18] was synthesized in the same manner as employed in synthesizing example 3 except replacing SP-28 by SP-13 in synthesizing example 3. Furthermore, polymer latexes [Lx-13, 14, 16, 19, 20] were synthesized in the same manner as employed in synthesizing example 3 in monomer composition shown in Table 2 except replacing SP-28 by the water soluble polymers shown in Table 2 in the same amount as that of SP-28.

Synthesizing examples for comparative latex polymers are shown below.

(Synthesizing example 7; synthesizing comparative latex, Lx-21)

In the same equipment as employed in synthesizing example 1 were added 340 ml of distilled water and aqueous solution containing 5 g of sodium dodecylsulfate. To thus obtained solution being heated and stirred at 80° C. under a nitrogen atmosphere was added 30 ml of water in which potassuim persulfate was dissolved in an amount of 1.5 wt % to a total weight of monomers to be added. Immediatly after the addition of potassuim persulfate, to the solution was dropped a mixed solution of 20 g of acetoacetoxyethylmethacrylate, 40 g of butylacrylate and 40 g of styrene taking 1 hour, and after dropping the solution was heated and stirred for 3 hours. Furthermore, 10 ml of water in which potassuim persulfate was dissolved in an amount of 0.5 wt % to a total weight of monomers was added to the above obtained solution, thus obtained solution was heated and stirred for still more 3 hours so as to complete polymerization reaction. Thereafter, the reacted mixture was allowed to cool down to room temperature to obtain [Lx-21]. Comparative polymer latexes [Lx-22 to Lx-24, Lx-27] were also synthesized in the same manner as employed in synthesizing example 7 in monomer composition shown in Table 2.

(Synthesizing example 8; synthesizing comparative latex, Lx-25)

Polymer latex [Lx-25] was synthesized in the same manner an emplyed in synthesizing example 1 except replacing monomers constituting polymer latex by 25 g of acetoacetoxyethylacrylate and 75 g of butylacrylate, and Lx-26 was also synthesized in the same manner as employed in synthesizing example 8 in monomer composition shown in Table 2.

The glass transition temperature of the ploymer latexes shown in Table 2 were measured employing a differential scanning type calorimeter in a manner in which polymer latex aqueous solution was dried at 50° C. under a vacuum atomosphere so as to prepare a dry membrane from which water was completely removed. Measuring the glass transition temperature of the ploymer latexes employing the differential scanning type calorimeter (DSC8230, produced by Rigaku Denki Co.) under a nitrogen atmosphere at increasing temperature rate of 10° C./min. resulted in that the glass transition temperature of the ploymer latexes other than those of Lx-1 to Lx-22 showed not lower than −20° C.

TABLE 2

| No. | Compound represented by A of Formula [1] Compound | Weight ratio | Compound represented by B of Formula [1] Compound | Weight ratio | Compound represented by C of Formula [1] Compound | Weight ratio | Protective colloidal compound in emulsion polymerization (water soluble polymer and/or surfactant) | Synthesizing example of latex | |
|---|---|---|---|---|---|---|---|---|---|
| Lx-1 | MN-1 | 0.1 | BA | 0.45 | St | 0.45 | SP-22, S-2 | Example (1) | Invention |
| Lx-2 | MN-1 | 0.2 | BA | 0.3 | St | 0.5 | SP-22, S-2 | According to Example (1) | Invention |
| Lx-3 | MN-1 | 0.2 | BA | 0.3 | CHMA | 0.5 | SP-22, S-2 | According to Example (1) | Invention |
| Lx-4 | MN-1 | 0.2 | BA | 0.3 | CHMA | 0.45 | SP-22, S-2 | According to Example (1) | Invention |
| | | | | | AA | 0.05 | | | |
| Lx-5 | MN-1 | 0.1 | AIN | 0.3 | CHMA | 0.6 | SP-22, S-2 | According to Example (1) | Invention |
| Lx-6 | MN-1 | 0.25 | AIN | 0.25 | CHMA | 0.5 | SP-22, S-2 | Example (2) | Invention |
| Lx-7 | MN-1 | 0.3 | AIN | 0.3 | CHMA | 0.4 | SP-22, S-2 | According to Example (2) | Invention |
| Lx-8 | MN-1 | 0.25 | EA | 0.35 | EMA | 0.4 | SP-22, S-2 | According to Example (2) | Invention |
| Lx-9 | MN-1 | 0.25 | EA | 0.35 | St | 0.4 | SP-22, S-2 | According to Example (2) | Invention |
| Lx-10 | MN-2 | 0.25 | BA | 0.45 | EMA | 0.3 | SP-22, S-2 | According to Example (2) | Invention |
| Lx-11 | MN-1 | 0.2 | AIN | 0.3 | St | 0.5 | SP-22, S-2 | According to Example (2) | Invention |
| Lx-12 | MN-1 | 0.2 | AIN | 0.3 | St | 0.5 | SP-28, S-2 | Example (3) | Invention |
| Lx-13 | MN-1 | 0.2 | AIN | 0.3 | St | 0.5 | SP-1, S-2 | According to Example (3) | Invention |
| Lx-14 | MN-1 | 0.2 | AIN | 0.3 | St | 0.5 | SP-2, S-2 | According to Example (3) | Invention |
| Lx-15 | MN-1 | 0.2 | AIN | 0.3 | St | 0.5 | SP-6, S-2 | Example (4) | Invention |
| Lx-16 | MN-1 | 0.2 | AIN | 0.3 | St | 0.5 | SP-7, S-2 | According to Example (3) | Invention |
| Lx-17 | MN-1 | 0.2 | AIN | 0.3 | St | 0.5 | SP-8, S-2 | Example (5) | Invention |
| Lx-18 | MN-1 | 0.2 | AIN | 0.3 | St | 0.5 | SP-13, S-2 | Example (6) | Invention |
| Lx-19 | MN-1 | 0.2 | AIN | 0.3 | St | 0.5 | SP-25, S-2 | According to Example (3) | Invention |
| Lx-20 | MN-1 | 0.2 | AIN | 0.3 | St | 0.5 | SP-26, S-2 | According to Example (3) | Invention |
| Lx-21 | MN-1 | 0.2 | AIN | 0.3 | St | 0.5 | S-2 | Example (7) | Comparison |
| Lx-22 | MN-1 | 0.2 | BA | 0.3 | St | 0.5 | S-2 | According to Example (7) | Comparison |
| Lx-23 | MN-1 | 0.15 | BA | 0.8 | AA | 0.05 | S-2 | According to Example (7) | Comparison |
| Lx-24 | MN-1 | 0.15 | BA | 0.85 | | | S-2 | According to Example (7) | Comparison |
| Lx-25 | MN-1 | 0.25 | BA | 0.75 | | | SP-22, S-2 | According to Example (8) | Comparison |
| Lx-26 | MN-1 | 0.25 | AIN | 0.75 | | | SP-22, S-2 | According to Example (8) | Comparison |

S-2 means sodium dodecylbenzenesulfonate

Example 2

(Preparing emulsion 1 and emulsion 2)

<Preparing emulsion 1>

First, hexagonal tabular seed emulsion Em-A of silver iodobrime was prepared below.

(Solution A)

| | |
|---|---|
| Ossein gelatin | 60.2 g |
| Distilled water | 20.0 1 |
| HO $(CH_2CH_2O)_n$ $[CH(CH_3)CH_2O]_{17}$ $(CH_2CH_2O)_mH$ (n + m = 5 to 7) (10% methanol solution) | 1.20 ml |
| Potassium bromide | 10.8 g |
| 10% $H_2SO_4$ | 144 ml |

(Solution B)

| | |
|---|---|
| Silver nitrate | 1487.5 g |
| Distilled water to make 3500 ml. | |

(Solution C)

| | |
|---|---|
| Potassium bromide | 1050 g |
| Potassium iodide | 29.3 g |

(Solution D)

1.75N potassium bromide aqueous solution

An amount for controlling the following silver potential

To solution A were added solutions B and C each in an amount of 64.1 ml at 35° C. by making use of a mixing stirrer shown in Japanese Patent Examined Publication Nos. 58-58288 and 58-58289, etc., in a double-jet process by taking 2.0 minutes, so that nucleus grains were formed.

After stopping the addition of solutions B and C, the temperature of solution A was raised to 60° C. by taking 60 minutes. Thereafter solutions B and C were each added thereto again at a flow rate of 68.5 ml/min. for 50 minutes in the double-jet process. During this time, the silver potential (measured by a silver-ion selection electrode together with a saturated silver-silver chloride electrode as a control electrode) was so controlled as to +6 mv by making use of solution D. After the completion of the addition, the pH was adjusted to 6.0 with a 3% KOH solution and desalting and washing treatments were immediately conducted so as to obtain seed emulsion A. The resulting seed emulsion A was proved through an electron microscope as follows. Not less than 90% of the whole projected area of the silver halide grains thereof was composed of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.07 $\mu$m and 0.5 $\mu$m, respectively. Further, the variation coefficient was proved to be 25% through electron microscopic observation.

Preparing Em-1

A tabular silver halide emulsion was prepared by using the following 4 kinds of solutions.

(Solution A)

| | |
|---|---|
| Ossein gelatin | 29.4 g |
| HO $(CH_2CH_2O)_n$ [CH $(CH_3)$ $CH_2O]_{17}$ $(CH_2CH_2O)_mH$ (n + m = 5 to 7) (10% methanol solution) | 1.25 ml |
| Em-A | 2.65 mole equivalent |
| Distilled water to make 3000 ml. | |

(Solution B)

| | |
|---|---|
| 3.5 N silver nitrate aqueous solution | 1760 ml |

(Solution C)

| | |
|---|---|
| Potassium bromide | 737 g |
| Distilled water to make 1760 ml. | |

(Solution D)

1.75N potassium bromide aqueous solution

An amount for controlling the following silver potential

To solution A were added total amount of solution B and C at 60° C. by making use of a mixing stirrer shown in Japanese Patent Examined Publication Nos. 58-58288 and 58-58289, etc. in a double-jet process by taking 110 minutes and in this process adding flow rate at the completion of addion was 3 times as fast as that at the beginning of addition. During this time, the silver potential was controlled to +40 mV using solution D.

A precipitation desalting was carried out according to the following method to remove an excessive amount of salts after addition.

1. A reaction solution after mixing was cooled down to 40° C. and to this solution were added phenylcarbamoyl modified gelatin (substituted ratio was 90%) as a flocculating gelatin in an amount of 20 g per mol of silver halide, and further by adding 56 wt % of acetic acid, pH of thus obtained solution was lowered to 4.30. The solution was left quietly so as to be decanted.

2. To the above obtained emulsion was added deionized water of 40° C. in an amount of 1.8 l per mol of silver halide, and thus obtained dispersion was stirred for 10 minutes and left quietly so as to be decanted.

3. The above-mentioned processes, 1 and 2 were repeated once more.

4. Thereafter, to the above obtained emulsion were added gelatin in an amount of 15 g per mol of silver halide, sodium carbonate and water. Thus obtained emulsion was dispersed at pH of 6.0. Finally, the emulsion was made up to be 450 ml per mol of silver halide.

By observing 3000 grains of thus obtained Em-1 employing electron microscope, it was proved that the grains were composed of hexagonal tabular grains whose average circle equivalent diameter was 0.59 μm and average thickness was 0.17 μm and variation coefficient was 24%.

Preparing Em-2

Em-2 having different grain size and grain thickness was prepared by varying to adjust the silver ion potential to −10 mV in preparing Em-1. By observing thus obtained Em-2 employing electron microscope, it was proved that the grains were composed of hexagonal tabular grains whose average circle equivalent diameter was 0.50 μm and average thickness was 0.07 μm and variation coefficient was 28%.

Making light-sensitive materials

On both sides of polyethyleneterephthalate film base (thickness of 175 μm) colored in blue of density of 0.15 were coated uniformly crossover cut layers, emulsion layers, intermediate layers and protective layers in this order and dried so as to obtain sample No. 1. The above obtained Em-1 and Em-2 were mixed in a ratio of 0.6:0.4. Coated silver amount was 1.3 g/m$^2$ and coated gelatin amount was 0.4 g/m$^2$ in the protective layer, 0.4 g/m$^2$ in the intermediate layer, 1.5 g/m$^2$ in the emulsion layer, 0.2 g/m$^2$ in the crossover cut layer, per one side of the sample.

First layer (crossover cut layer)

| | |
|---|---|
| Solid fine particle dispersion dye (AH) | 180 mg/m$^2$ |
| Gelatin | 0.2 g/m$^2$ |
| Sodium dodecylbenzenesulfonate | 5 mg/m$^2$ |
| Compound (I) | 5 mg/m$^2$ |
| Active methylene latex Lx-1 | 0.16 mg/m$^2$ |
| Sodium 2,4-dichloro-6-hydroxy-1,3,5-triazine | 5 mg/m$^2$ |
| Colloidal silica (average particle size of 0.014 μm) | 10 mg/m$^2$ |
| Hardener (A) | 2 mg/m$^2$ |

second layer (emulsion layer)

To the above ebtained mixed emulsion were added the following various additives.

| | |
|---|---|
| Compound (G) | 0.5 mg/m$^2$ |
| 2,6-bis(hydroxyamino)-4-diethylamino-1,3,5-triazine | 5 mg/m$^2$ |
| t-butylcatechol | 130 mg/m$^2$ |
| Polyvinylpyrrolidone (molecular weight 10,000) | 35 mg/m$^2$ |
| Styrene-maleic acid anhydride copolymer | 80 mg/m$^2$ |
| Sodium polystyrenesulfonate | 80 mg/m$^2$ |
| Trimethylolpropapne | 350 mg/m$^2$ |
| Diethyleneglycol | 50 mg/m$^2$ |
| Nitrophenyl-triphenylphosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH$ (OH) $CH_2N$ $(CH_2COOH)_2$ | 350 mg/m$^2$ |
| Compound (M) | 5 mg/m$^2$ |
| Compound (N) | 5 mg/m$^2$ |
| Colloidal silica | 0.4 g/m$^2$ |
| Active methylene latex Lx-1 | 0.3 g/m$^2$ |
| Dextran (average molecular weight 1,000) | 0.2 g/m$^2$ |
| Compound (P) | 0.2 g/m$^2$ |
| Compound (Q) | 0.2 g/m$^2$ |

Third layer (intermediate layer)

| | |
|---|---|
| Gelatin | 0.4 g/m$^2$ |
| Formaldehyde | 10 mg/m$^2$ |
| Sodium 2,4-dichloro-6-hydroxy-1,3,5-triazine | 5 mg/m$^2$ |
| Bis-vinylsulfonylmethylether | 18 mg/m$^2$ |
| Active methylene latex Lx-1 | 0.1 g/m$^2$ |
| Sodium polyacrylate | 10 mg/m$^2$ |
| Compound (S-1) | 3 mg/m$^2$ |
| Compound (K) | 5 mg/m$^2$ |
| Hardener (B) | 1 mg/m$^2$ |
| Gelatin | 0.4 g/m$^2$ |
| Matting agent composed of polymethylmethacrylate (area average particle size 7.0 μm) | 50 mg/m$^2$ |
| Formaldehyde | 10 mg/m$^2$ |
| Sodium 2,4-dichloro-6-hydroxy-1,3,5-triazine | 5 mg/m$^2$ |
| Bis-vinylsulfonylmethylether | 18 mg/m$^2$ |
| Active methylene latex Lx-1 | 0.1 g/m$^2$ |
| Polyacrylamide (average molecular weight 10,000) | 0.05 g/m$^2$ |
| Sodium polyacrylate | 20 mg/m$^2$ |

-continued

| | |
|---|---|
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}O\ (CH_2CH_2O)_{11}H$ | 3 mg/m$^2$ |
| $C_8F_{17}SO_2N\ (C_3H_7)\text{-}(CH_2CH_2O)_{15}H$ | 2 mg/m$^2$ |
| $C_8F_{17}SO_2N\ (C_3H_7)\text{-}(CH_2CH_2O)_4\text{-}(CH_2)_4SO_3Na$ | 1 mg/m$^2$ |
| Hardener (B) | 1.5 mg/m$^2$ |

Compound (G)

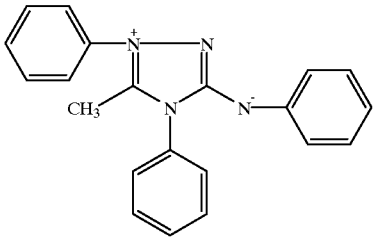

Compound (H)

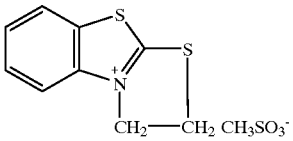

Compound (I)

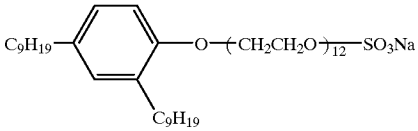

Compound (J)

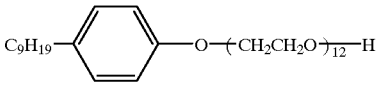

Compound (K)

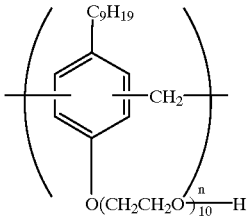

(Mixture of n = 2 to 5)

Compound (S-1)

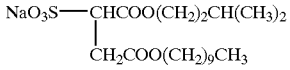

Compound (S-2)

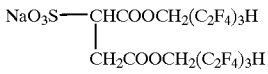

Latex (L)

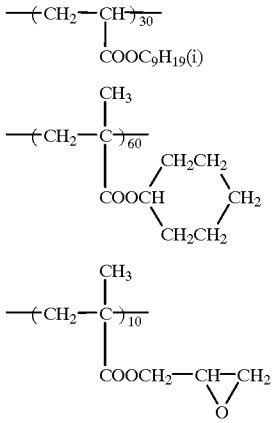

Polysiloxane (S1)

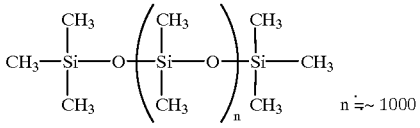

Solid fine particle dispersion dye (AH)

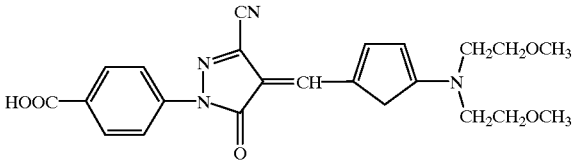

Compound (O)

$C_{11}H_{23}CONH(CH_2CH_2O)_5H$

Compound (M)

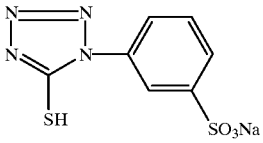

Compound (N)

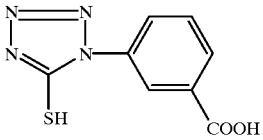

Hardener (A)

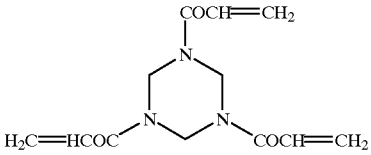

Compound (P)

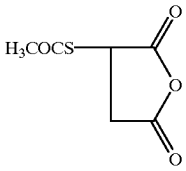

-continued

Compound (Q)

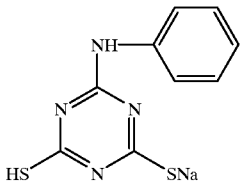

Hardener (B)

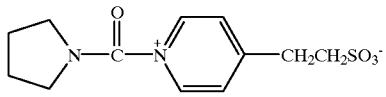

Samples were produced in the similar manner as employed in producing sample No. 1 except that kinds and amounts of active methylene latexes were prepared as shown in Table 3 (sample No. 2 to 31). Samples 32, 33 were produced using active methylene latex synthesized according to the method described in Japanese Patent Examined Publication No. 45-5819, referential example 6 and latex synthesized according to the method JP-A No. 8-248548, synthesizing example 1 respectively.

Evaluation of Samples

<Evaluation of storage stability>

The above produced samples were allowed to stand for a week under the condition of 40° C., 80%. Thus treated samples were sandwiched between fluorescent screens and subjected to X-ray wedge exposure through Penetrometer B type (produced by Konica Medical Co.). The exposed samples were processed by SR-DF processing solution (produced by Konica Co.) employing an automatic processor SRX-503 (produced by Konica Co.). Development temperature was 35° C. and total processing time was 45 seconds. Replenishment amount of developing solution and that of fixing solution were each 210 ml/m$^2$. Fog density of unexposed samples were measured. The difference between the fog density of comparative sample 29 and that of inventive samples was to be an index for storage stability.

<Covering power>

With respect to covering power, a value was obtained by dividing maximum density of sample 29 by coated silver amount. The values of other samples were obtained in the same way. When the value of sample 29 represents 100, the relative values of other samples are shown in Table 3.

<Pressure>

Unexposed sample was placed on a flat plane and a sponge brush adhered on a board was placed on the unexposed sample so that the brush side can contact with the surface of the unexposed sample. Thereafter a weight was placed on the board and then the sample was pulled out from between the flat plane and the sponge. Thus obtained sample was developed and occurrence of fog was evaluated based on the following criteria.

5: Fog was not observed at all.

4: Slight fog was partially produced.

3: Slight fog was produced over all.

2: Fog was produced over all and high fog density was partially produced.

1: High fog density was produced over all.

Results obtained for samples 1 to 33 were listed in

TABLE 3

| Sample No. | Kind and amount of used latex (g/1 g gelatin) 4th layer | | 3rd layer | | 2nd layer | | 1st layer | |
|---|---|---|---|---|---|---|---|---|
| 1 | Lx-1 | 0.8 | Lx-1 | 0.2 | Lx-1 | 0.25 | Lx-1 | 0.25 |
| 2 | Lx-2 | 0.8 | Lx-2 | 0.2 | Lx-2 | 0.25 | Lx-2 | 0.25 |
| 3 | Lx-3 | 0.8 | Lx-3 | 0.2 | Lx-3 | 0.25 | Lx-3 | 0.25 |
| 4 | Lx-4 | 0.8 | Lx-4 | 0.2 | Lx-4 | 0.25 | Lx-4 | 0.25 |
| 5 | Lx-5 | 0.8 | Lx-5 | 0.2 | Lx-5 | 0.25 | Lx-5 | 0.25 |
| 6 | Lx-6 | 0.8 | Lx-6 | 0.2 | Lx-6 | 0.25 | Lx-6 | 0.25 |
| 7 | Lx-6 | 0.4 | Lx-6 | 0.1 | Lx-6 | 0.15 | Lx-6 | 0.15 |
| 8 | Lx-6 | 1.2 | Lx-6 | 0.3 | Lx-6 | 0.4 | Lx-6 | 0.4 |
| 9 | Lx-7 | 0.8 | Lx-7 | 0.2 | Lx-7 | 0.25 | Lx-7 | 0.25 |
| 10 | Lx-8 | 0.8 | Lx-8 | 0.2 | Lx-8 | 0.25 | Lx-8 | 0.25 |
| 11 | Lx-9 | 0.8 | Lx-9 | 0.2 | Lx-9 | 0.25 | Lx-9 | 0.25 |
| 12 | Lx-10 | 0.8 | Lx-10 | 0.2 | Lx-10 | 0.25 | Lx-10 | 0.25 |
| 13 | Lx-11 | 0.8 | Lx-11 | 0.2 | Lx-11 | 0.25 | Lx-11 | 0.25 |
| 14 | Lx-12 | 0.8 | Lx-12 | 0.2 | Lx-12 | 0.25 | Lx-12 | 0.25 |
| 15 | Lx-13 | 0.8 | Lx-13 | 0.2 | Lx-13 | 0.25 | Lx-13 | 0.25 |
| 16 | Lx-14 | 0.8 | Lx-14 | 0.2 | Lx-14 | 0.25 | Lx-14 | 0.25 |
| 17 | Lx-15 | 0.8 | Lx-15 | 0.2 | Lx-15 | 0.25 | Lx-15 | 0.25 |
| 18 | Lx-16 | 0.8 | Lx-16 | 0.2 | Lx-16 | 0.25 | Lx-16 | 0.25 |
| 19 | Lx-17 | 0.8 | Lx-17 | 0.2 | Lx-17 | 0.25 | Lx-17 | 0.25 |
| 20 | Lx-18 | 0.8 | Lx-18 | 0.2 | Lx-18 | 0.25 | Lx-18 | 0.25 |
| 21 | Lx-19 | 0.8 | Lx-19 | 0.2 | Lx-19 | 0.25 | Lx-19 | 0.25 |
| 22 | Lx-20 | 0.8 | Lx-20 | 0.2 | Lx-20 | 0.25 | Lx-20 | 0.25 |
| 23 | — | 0 | — | 0 | Lx-6 | 0.4 | Lx-6 | 0.4 |
| 24 | — | 0 | Lx-6 | 0.4 | — | 0 | Lx-6 | 0.4 |
| 25 | Lx-2 | 0.8 | Lx-6 | 0.2 | Lx-11 | 0.25 | Lx-6 | 0.25 |
| 26 | Lx-25 | 0.8 | Lx-25 | 0.2 | Lx-25 | 0.25 | Lx-25 | 0.25 |
| 27 | Lx-26 | 0.8 | Lx-26 | 0.2 | Lx-26 | 0.25 | Lx-26 | 0.25 |
| 28 | Lx-21 | 0.8 | Lx-21 | 0.2 | Lx-21 | 0.25 | Lx-21 | 0.25 |
| 29 | Lx-22 | 0.8 | Lx-22 | 0.2 | Lx-22 | 0.25 | Lx-22 | 0.25 |
| 30 | Lx-23 | 0.8 | Lx-23 | 0.2 | Lx-23 | 0.25 | Lx-23 | 0.25 |
| 31 | Lx-24 | 0.8 | Lx-24 | 0.2 | Lx-24 | 0.25 | Lx-24 | 0.25 |
| 32 | Lx-27 | 0.8 | Lx-27 | 0.2 | Lx-27 | 0.25 | Lx-27 | 0.25 |
| 33 | Lx-28 | 0.8 | Lx-28 | 0.2 | Lx-28 | 0.25 | Lx-28 | 0.25 |

| Sample No. | Pressure level | cp ratio | Storage stability, fog density difference | Remarks |
|---|---|---|---|---|
| 1 | 5 | 110 | −0.022 | Invention |
| 2 | 5 | 110 | −0.026 | Invention |
| 3 | 5 | 110 | −0.026 | Invention |
| 4 | 5 | 110 | −0.022 | Invention |
| 5 | 5 | 110 | −0.022 | Invention |
| 6 | 5 | 115 | −0.026 | Invention |
| 7 | 5 | 105 | −0.028 | Invention |
| 8 | 5 | 110 | −0.016 | Invention |
| 9 | 5 | 110 | −0.024 | Invention |
| 10 | 5 | 110 | −0.024 | Invention |
| 11 | 5 | 110 | −0.024 | Invention |
| 12 | 5 | 105 | −0.014 | Invention |
| 13 | 5 | 110 | −0.028 | Invention |
| 14 | 5 | 105 | −0.03 | Invention |
| 15 | 5 | 105 | −0.032 | Invention |
| 16 | 5 | 105 | −0.032 | Invention |
| 17 | 5 | 105 | −0.028 | Invention |
| 18 | 5 | 105 | −0.026 | Invention |
| 19 | 5 | 105 | −0.03 | Invention |
| 20 | 5 | 115 | −0.018 | Invention |
| 21 | 5 | 115 | −0.024 | Invention |
| 22 | 5 | 115 | −0.028 | Invention |
| 23 | 5 | 105 | −0.032 | Invention |
| 24 | 5 | 115 | −0.026 | Invention |
| 25 | 5 | 110 | −0.026 | Invention |
| 26 | 4 | 110 | −0.026 | Invention |
| 27 | 4 | 110 | −0.024 | Invention |
| 28 | 3 | 100 | 0.002 | Comparison |
| 29 | 3 | 100 | 0 | Comparison |
| 30 | 2 | 100 | 0.004 | Comparison |
| 31 | 2 | 100 | 0.004 | Comparison |
| 32 | 2 | 105 | 0.004 | Comparison |
| 33 | 2 | 100 | −0.004 | Comparison |

What is claimed is:

1. An image forming material comprising a support and a layer, wherein said layer is formed by coating a composition containing latex comprising a latex polymer having an ethylenically unsaturated monomer unit containing an active methylene group and an ethylenically unsaturated monomer unit selected from methacrylic acid ester, acrylic acid ester, maleic acid ester and diene derivative produced in the presence of a water soluble polymer as a protective colloid through emulsion polymerization; said latex polymer being represented by the following Formula (1), $$-(A)x-(B)y-(C)z- \qquad \text{Formula (1)}$$

wherein, A represents the ethylenically unsaturated monomer unit containing the active methylene group and is represented by the following Formula (2); B represents the ethylenically unsaturated monomer unit selected from methacrylic acid ester, acrylic acid ester or maleic acid ester or diene derivative, having a glass transition temperature of not higher than 35° C.; C represents an ethylenically unsaturated monomer unit, which has a glass transition temperature of higher than 35° C. other than A and B; x, y and z represent weight percentage ratio of each component in said polymer, and x, y and z are defined as and $2 \leqq x \leqq 20$, $5 \leqq y \leqq 50$ and $x+y+z=100$;

$$CH_2{=}C(R^1)L{-}X \qquad \text{Formula (2)}$$

wherein $R^1$ represents a hydrogen atom, an alkyl group having 1 to 4 carbon atom(s) or a halogen atom, L represents a single bond or a divalent linking group, and X represents a monovalent group containing an active methylene group.

2. The image forming material of claim 1, wherein X' is $R^8COCH_2COO$—, $CNCH_2COO$—, $R^8COCH_2CO$— or $R^8COCH_2CON(R^5)$—, wherein $R^5$ represents a hydrogen atom, a substituted or an unsubstituted alkyl group having 1 to 6 carbon atom(s), and $R^8$ represents an alkyl group having 1 to 12 carbon atom(s), an aryl group, an alkoxy group, a cycloalkyloxy group, an aryloxy group, an amino group, the groups represented as $R^8$ can be substituted.

3. The image forming material of claim 1, wherein B is alkylacrylate having a branched alkyl chain having not less than two carbon atoms, alkylmethacrylate having a branched alkyl chain having not less than six carbon atoms or diene derivative of which glass transition temperature is not higher than 10° C.

4. An image forming material having a support and a silver halide photographic light sensitive emulsion layer, wherein the image forming material contains latex comprising a latex polymer having an ethylenically unsaturated monomer unit containing an active methylene group and an ethylenically unsaturated monomer unit selected from methacrylic acid ester, acrylic acid ester, maleic acid ester and diene derivative produced in the presence of the water soluble polymer through emulsion polymerization; said latex polymer being represented by the following Formula (1), $$-(A)x-(B)y-(C)z \qquad \text{Formula (1)}$$

wherein, A represents the ethylenically unsaturated monomer unit containing the active methylene group and is represented by the following Formula (2); B represents the ethylenically unsaturated monomer unit selected from methacrylic acid ester, acrylic acid ester maleic acid or diene derivative, and has a glass transition temperature of not higher than 35° C.; C represents an ethylenically unsaturated monomer unit, which has a glass transition temperature of higher than 35° C., other than A and B; x, y and z represent weight percentage ratio of each component in said polymer, and x, y and z are defined as and $2 \leqq x \leqq 20$, $5 \leqq y \leqq 50$ and $x+y+z=100$;

$$CH_2{=}C(R^1)L{-}X \qquad \text{Formula (2)}$$

wherein $R^1$ represents a hydrogen atom, an alkyl group having 1 to 4 carbon atom(s) or a halogen atom, L represents a single bond or a divalent linking group, and X represents a monovalent group containing an active methylene group.

5. The image forming material of claim 1, wherein the water soluble polymer is an anionic water soluble polymer, a nonionic water soluble polymer or a natural polymer.

6. The image forming material of claim 5, wherein the water soluble polymer is an anionic water soluble polymer and said polymer is composed of not less than two kinds of monomer units selected from the ethylenically unsaturated monomer unit and a conjugated diene monomer unit, and content of an anionic monomer unit is not less than 60% in weight ratio.

7. The image forming material of claim 5, wherein the water soluble polymer is an anionic water soluble polymer and said polymer contains a conjugated diene type sulfonic acid or its alkaline salt.

8. The image forming material of claim 7, wherein the conjugated diene type sulfonic acid or its alkaline salt is styrenesulfonic acid or its alkaline salt.

9. The image forming material of claim 5, wherein the water soluble polymer is a nonionic water soluble polymer and said polymer is composed of not less than two kinds of monomer units selected from the ethylenically unsaturated monomer unit and a conjugated diene monomer unit, and content of a nonionic monomer unit is not less than 60% in weight ratio.

10. The image forming material of claim 5, wherein the water soluble polymer is a natural water soluble polymer which is a dextran derivative.

11. The image forming material of claim 5, wherein the water soluble polymer contains acrylamide derivative or methacrylamide derivative unit.

12. The image forming material of claim 5, wherein the water soluble polymer contains vinylpyrrolidone unit.

13. The image forming material of claim 1, wherein a glass transition temperature of the polymer latex is not lower than −20° C.

14. The image forming material of claim 4, wherein the image forming material having a non-lightsensitive layer, and the polymer latex is contained in one or more layers of the light-sensitive emulsion layer or a non-lightsensitive layer.

* * * * *